United States Patent [19]

Crowe

[11] 4,044,826

[45] Aug. 30, 1977

[54] RETRIEVABLE WELL PACKERS

[75] Inventor: Talmadge L. Crowe, Houston, Tex.

[73] Assignee: Baker International Corporation, Orange, Calif.

[21] Appl. No.: 686,886

[22] Filed: May 17, 1976

[51] Int. Cl.[2] ..... E21B 23/00

[52] U.S. Cl. ..... 166/120; 166/182

[58] Field of Search ..... 166/120, 123–125, 166/134, 181, 182, 212, 217

[56] References Cited

U.S. PATENT DOCUMENTS

| | | | |
|---|---|---|---|
| 3,054,450 | 9/1962 | Baker | 166/120 |
| 3,361,209 | 1/1968 | Edwards, Jr. | 166/120 |
| 3,456,723 | 7/1969 | Current et al. | 166/134 |
| 3,678,998 | 7/1972 | Cockrell et al. | 166/134 |
| 3,976,133 | 8/1967 | Allen | 166/120 |

*Primary Examiner*—James A. Leppink

[57] ABSTRACT

A retrievable packer is lowered into a well casing on a tubular string, the packer having expanders and coengageable slips expandable outwardly by fluid pressure into anchoring engagement with the well casing to prevent packer movement in both upward and downward directions. After the slips are set, the packing assembly for the packer is expanded by fluid pressure into sealing engagement with the well casing. Differential pressure in the tubing-casing annulus above the packing assembly, operates over booster areas to increase the pack-off force of the packing elements of the packing assembly against the casing to insure against leakage, providing a self-energizing system, the pack-off force on the packing elements being trapped to prevent its subsequent dimunition. Forces applied to the tubing string, either tensile or compressive, are transmitted directly to the slips and into the casing without passing through the packing, thereby having no effect on the latter. The packer is releasable from the casing either by manipulation of the tubular string or by wireline apparatus lowered through the tubing string into the packer, the packer then being removed from the casing by the tubular string.

43 Claims, 32 Drawing Figures

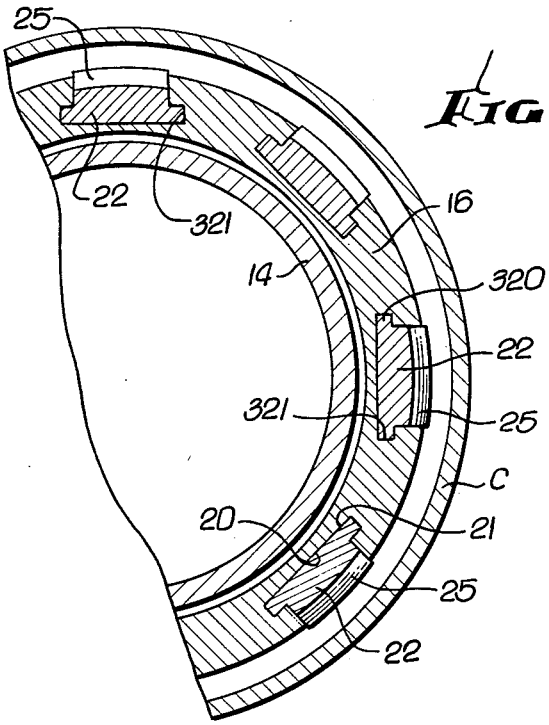
FIG. 8.
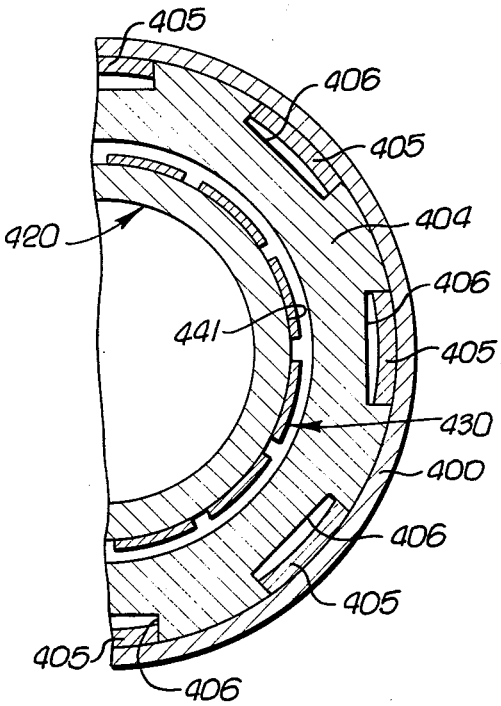
FIG. 9.
FIG. 10.
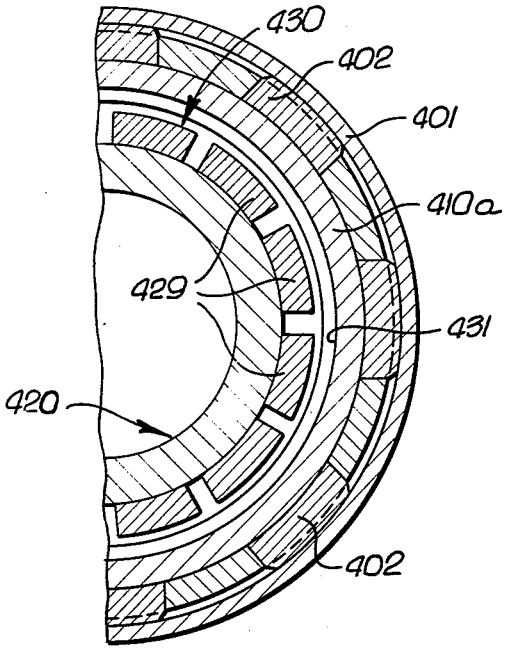

RETRIEVABLE WELL PACKERS

The present invention relates to well packers adapted to be anchored in packed off condition in well casing, and more particularly to well packers of the retrievable type.

Well packers are known which can be anchored in packed-off condition in well casing against movement in both longitudinal directions, as disclosed in U.S. Pat. No. 3,507,327, for example. The body or mandrel is connected to a tubular string. Upper and lower expanders and intervening normally retracted slips are disposed externally of the body, as well as a normally retracted packing structure. The slips are expanded outwardly against the casing by transmitting downward movement and force of the body through the packing structure to the expanders and slips, continuation of the downward movement and force of the body compressing the packing structure and effecting its outward expansion into sealing engagement with the well casing.

Packers of the type disclosed in the above patent operate satisfactorily when connected to the usual relatively small sizes of tubular strings. However, with large diameter tubular strings, such as 7 inch O.D. casing, the forces that could be imposed on the relatively thin packing elements of the packing assembly by the thermal expansion and contraction of the tubular string could damage the packing elements, resulting in their failure. Such movement of the tubular string could increase the pack-off force imposed on the packing elements to a detrimentally high value, or decrease the pack-off force with resultant fluid leakage past the packing elements.

In addition to the foregoing problems with prior well packers, the slips and/or packing elements are sometimes prematurely expanded against the casing during lowering of the packer in the casing string, resulting from dragging of the packer against the casing wall or by pushing the packer through tight spots or around dog legs in the casing string.

With packer apparatus embodying the present invention, the above difficulties encountered with prior well packers are overcome. Upward and downward forces of the tubular string and packer body connected thereto are transmitted directly through the slips to the surrounding well casing, bypassing the packing structure. The packing elements are expanded outwardly against the well casing after the slips have been set, and without imposing the slip setting force on the packing elements. The packing elements are retained in sealed relation against the casing by locking the packing structure in its compressed condition. Additional force can be imposed on the packing elements to effect their further compression by relative movement of parts of the packing structure, and such compression will be retained by trapping or locking such parts in their new relative positions.

The well packer embodies a pressure boosting arrangement for increasing the pack-off force on the packing elements. The packing elements are expanded initially against the casing by applying and trapping compressive force against the ends of the packing elements. After the packer has been fully set in the well casing, a pressure differential in the tubing-casing annulus across the packing structure from above or below it, will act over a supplemental area in addition to the end area of the packed off packing elements thereby providing a booster force to add to the fluid force acting on the packing element and to the initial trapped compressive force, thereby insuring a tighter seal against the casing. This tighter seal will be retained by locking or trapping, in their new relative positions, the components of the well packer which apply the compressive force to the packing elements.

Release of the well packer from the casing and its retrieval in a relatively simple manner are accomplished by appropriate manipulation of the main body of the packer, as by rotating the tubular string to which the body is secured. Alternatively, release can be accomplished without movement of the tubular string and body by operating equipment lowered through the tubular string into the body to release parts holding the slips anchored against the body, after which the tubular string need merely be elevated to remove the packer from the casing string.

This invention possesses many other advantages, and has other objects which may be made more clearly apparent from a consideration of several forms in which it may be embodied. Such forms are shown in the drawings accompanying and forming part of the present specification. These forms will now be described in detail for the purpose of illustrating the general principles of the invention; but it is to be understood that such detailed description is not to be taken in a limiting sense.

Referring to the drawings:

FIGS. 1*a*, 1*b*, 1*c*, 1*d*, 1*e*, 1*f*, 1*g*, and 1*h* together constitute a longitudinal section through a well packer apparatus embodying the invention prior to setting of the apparatus in well casing, FIGS. 1*b*, 1*c*, 1*d*, 1*e*, 1*f*, 1*g*, and 1*h* constituting progressive downward continuations of FIGS. 1*a*, 1*b*, 1*c*, 1*d*, 1*e*, 1*f*, and 1*g*, respectively, FIGS. 1*a* to 1*f*, inclusive, and 1*h* being partial sections through the apparatus and casing, whereas FIG. 1*g* is a combined side elevational view and longitudinal section through a portion of the apparatus;

FIGS. 2*a*, 2*b*, 2*c*, 2*d*, 2*e*, 2*f* 2*g*, and 2*h* are quarter longitudinal sections through the apparatus disclosed in FIGS. 1*a* to 1*g*, with the apparatus anchored in packed-off condition in the casing, FIGS. 2*b*, 2*c*, 2*d*, 2*e*, 2*f*, 2*g*, and 2*h* being downward continuations of FIGS. 2*a*, 2*b*, 2*c*, 2*d*, 2*e*, 2*f*, and 2*g*, respectively;

FIGS. 3*a*, 3*b*, 3*c*, 3*d*, 3*e*, 3*f*, and 3*g* are quarter longitudinal sections through the apparatus after it has been released from the well casing, FIGS. 3*b*, 3*c*, 3*d*, 3*e*, 3*f*, and 3*g* being downward continuations of FIGS. 3*a*, 3*b*, 3*c*, 3*d*, 3*e*, and 3*f*, respectively;

Figure 6A:
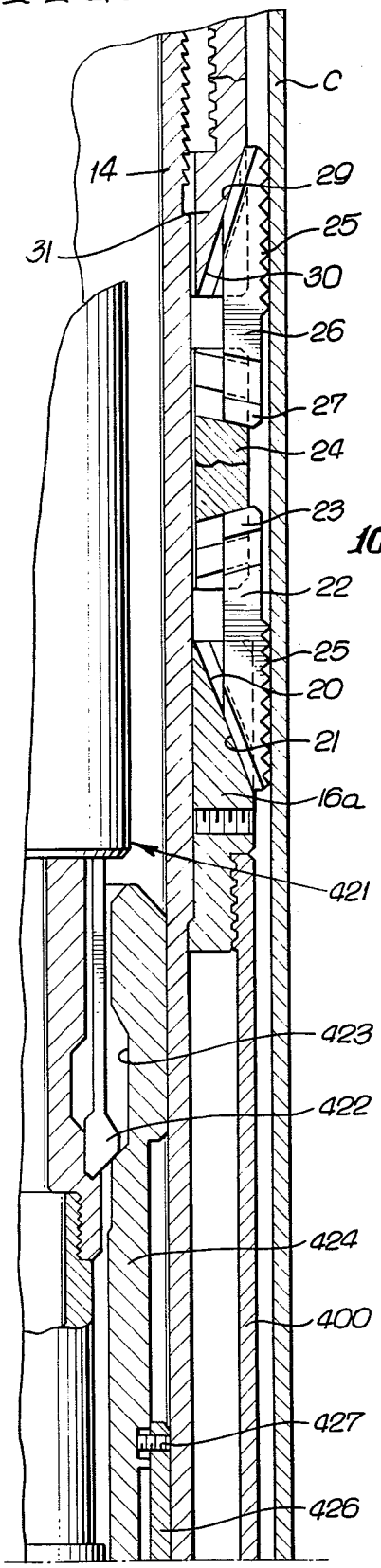
Figure 6B:
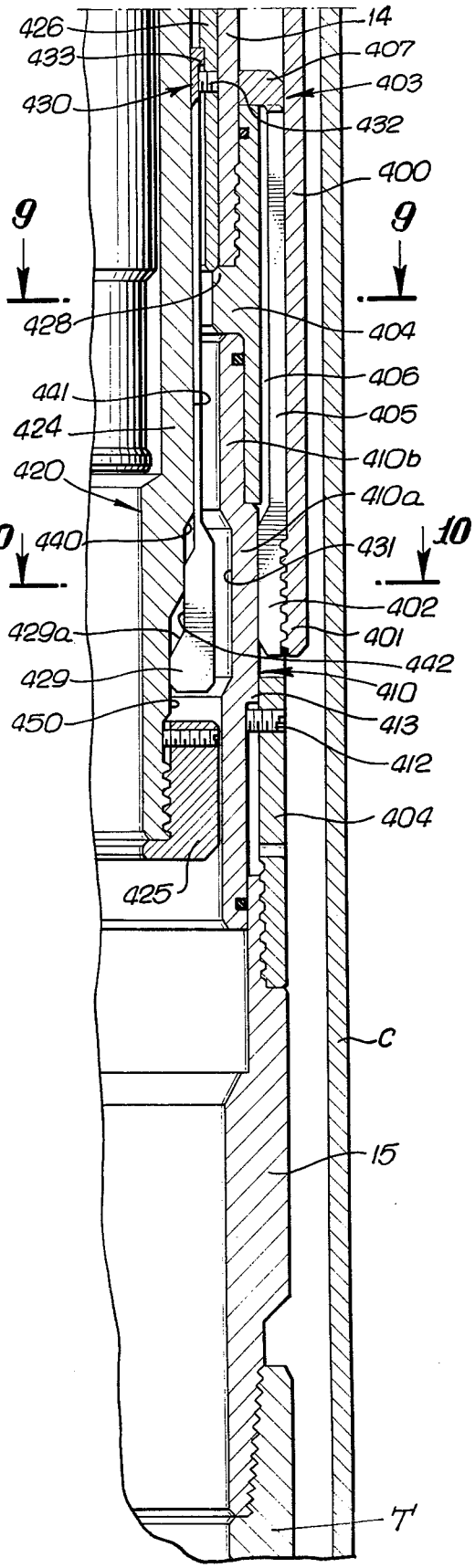

FIG. 6*a* and 6*b* together constitute a partial longitudinal section through a modified form of apparatus for effecting release of the well packer slips from the well casing, FIG. 6*b* being a lower continuation of FIG. 6*a;*

Figure 7A:
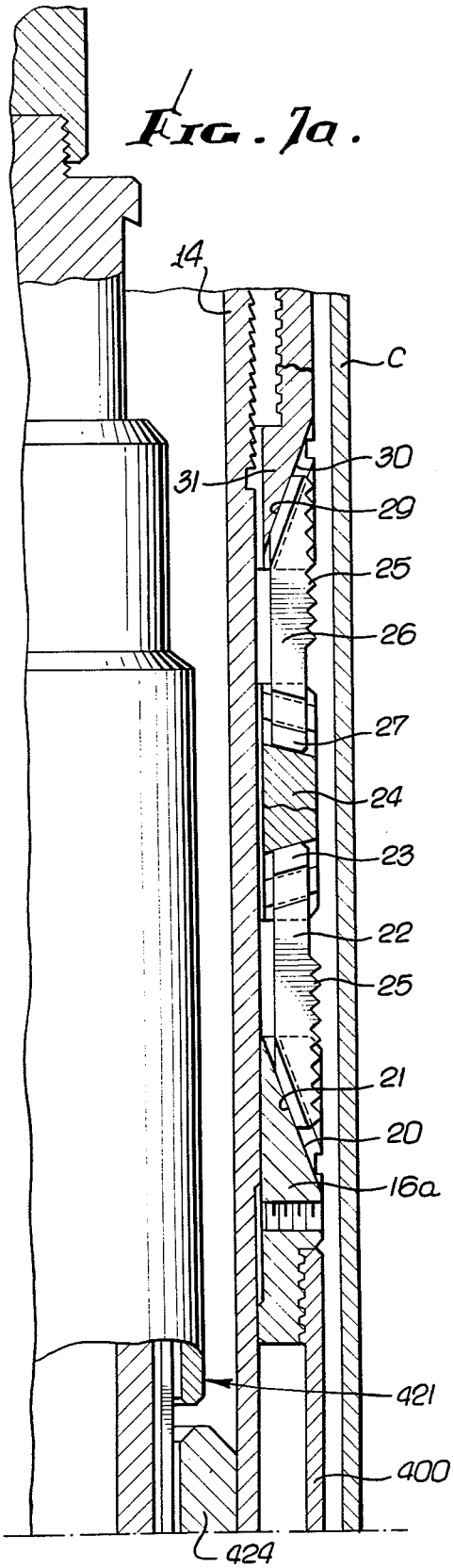
Figure 7B:
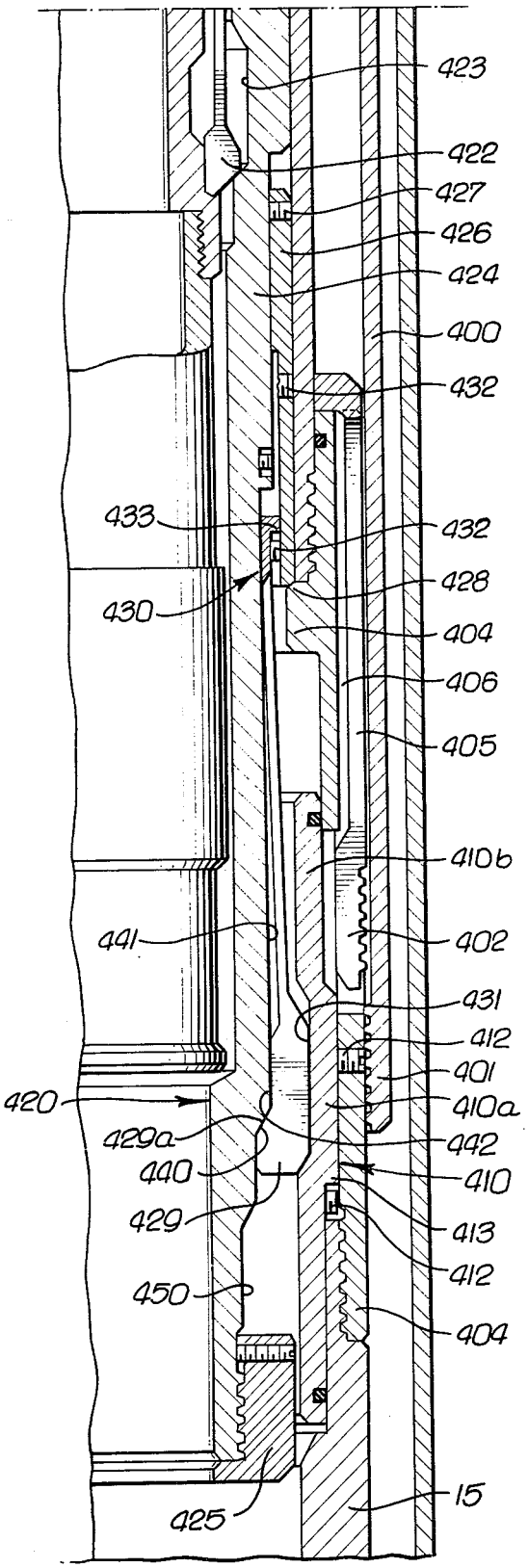

FIGS. 7*a* and 7*b* are views corresponding to FIGS. 6*a* and 6*b* disclosing the packer slips having been released from the well casing, FIG. 7*b* being the lower continuation of FIG. 7*a;*

Figure 1A:
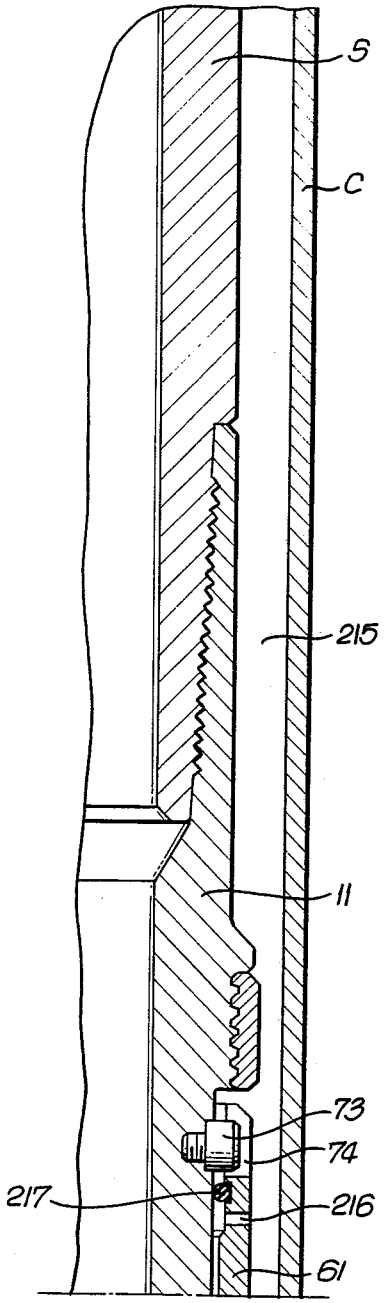
Figure 1B:
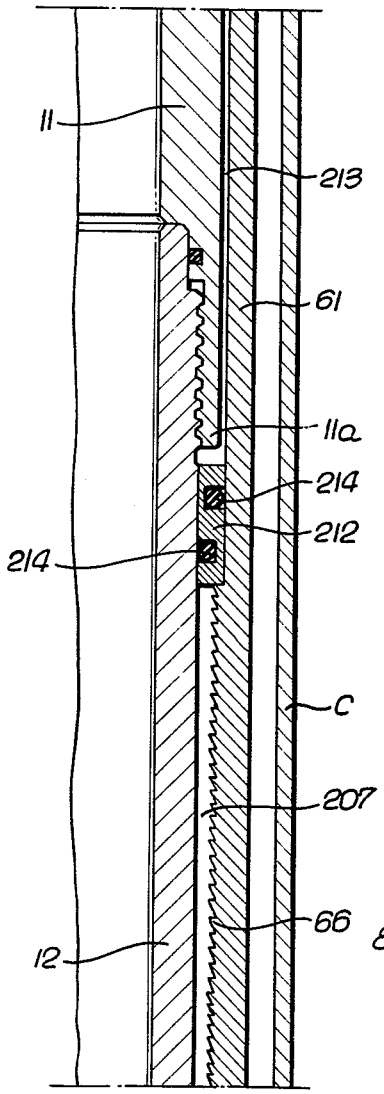
Figure 1C:
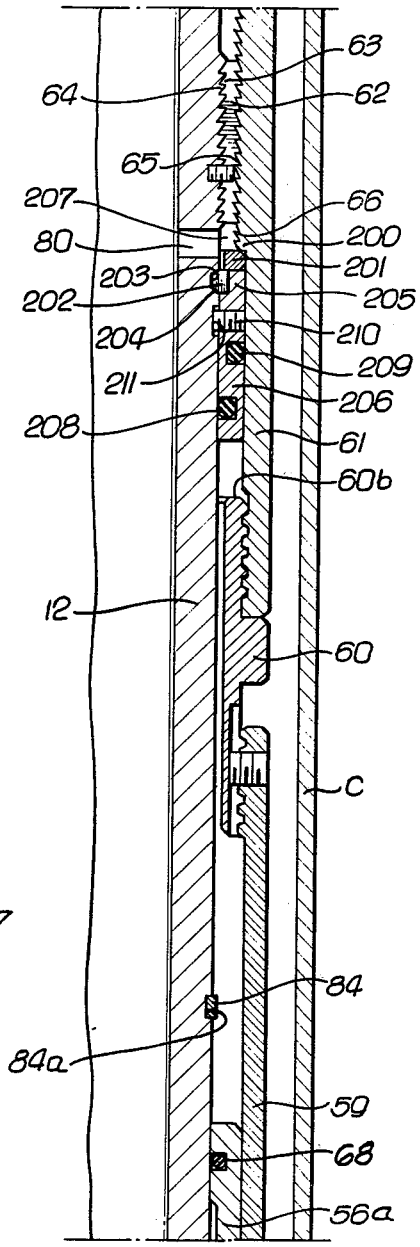
Figure 1D:
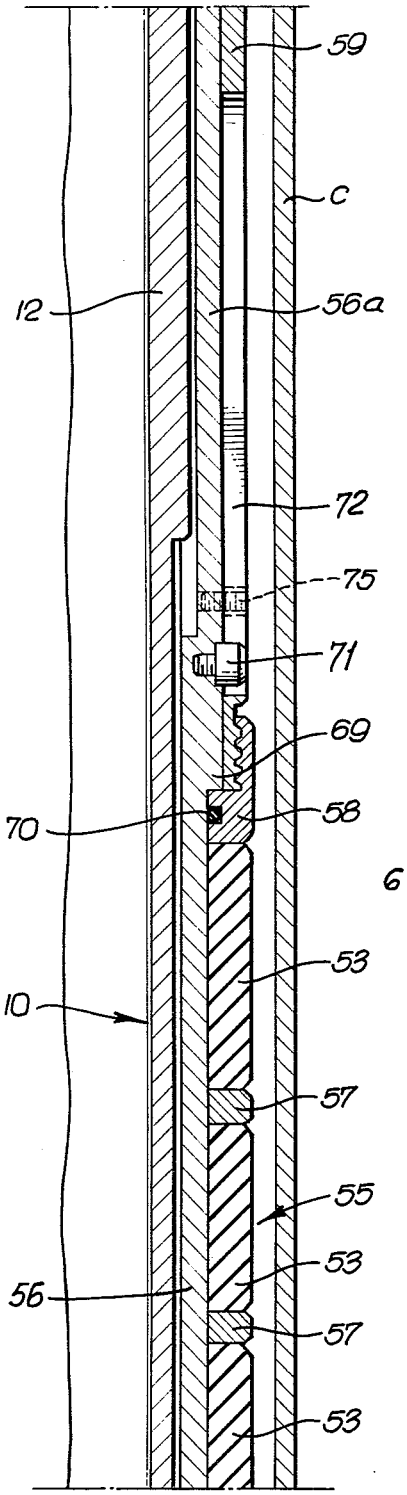
Figure 1E:
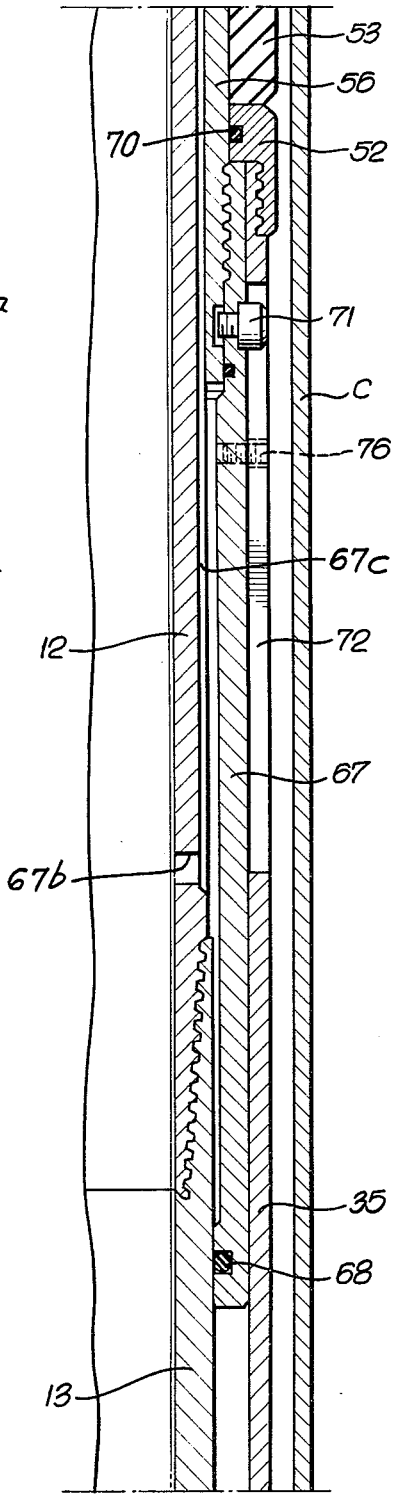
Figure 1F:
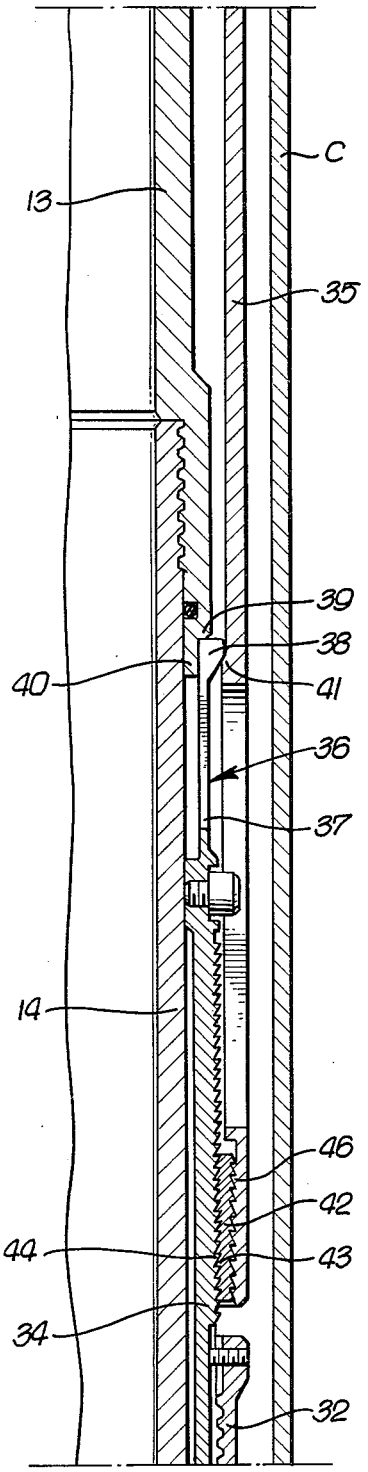
Figure 1G:
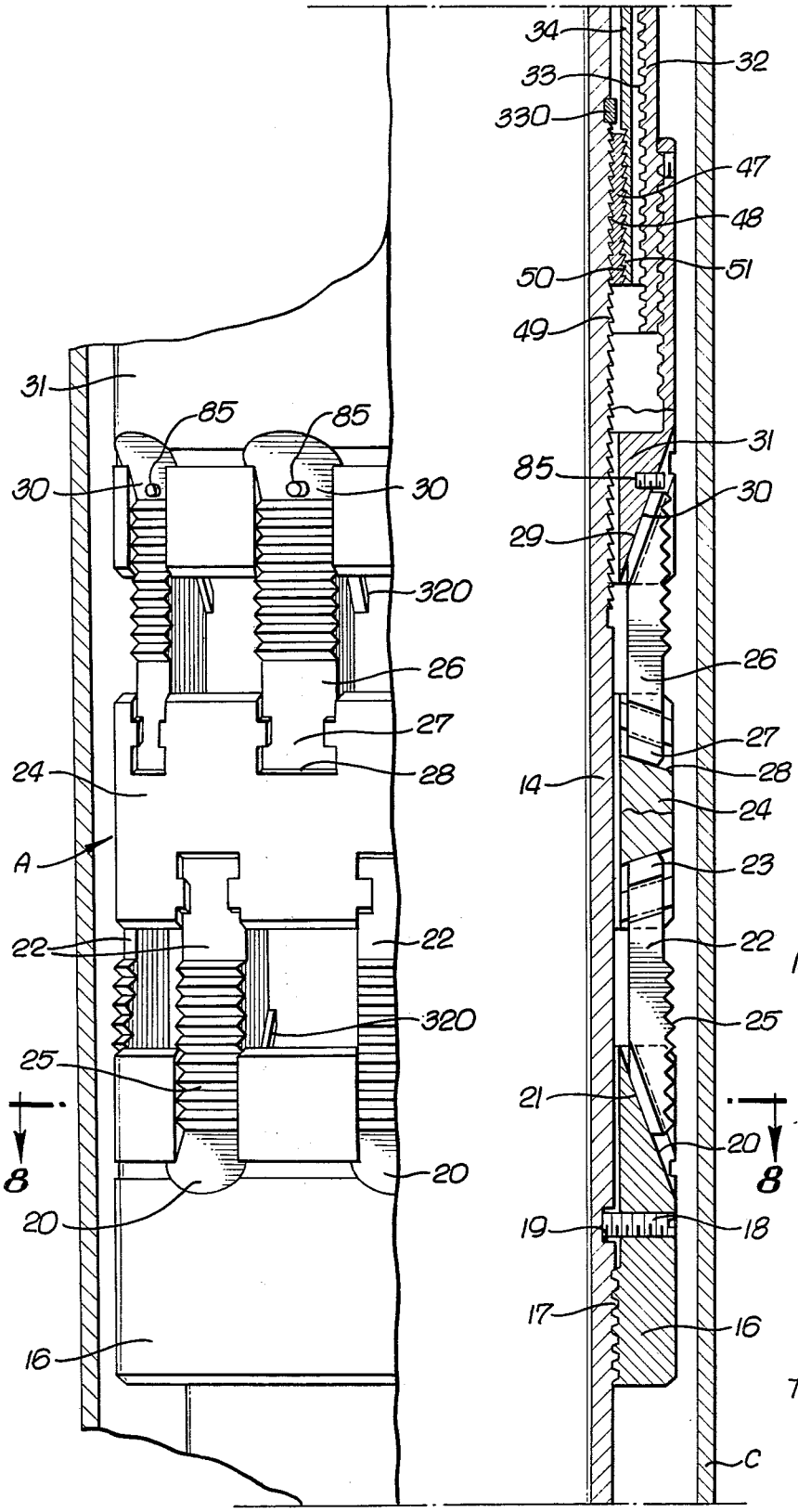
Figure 1H:
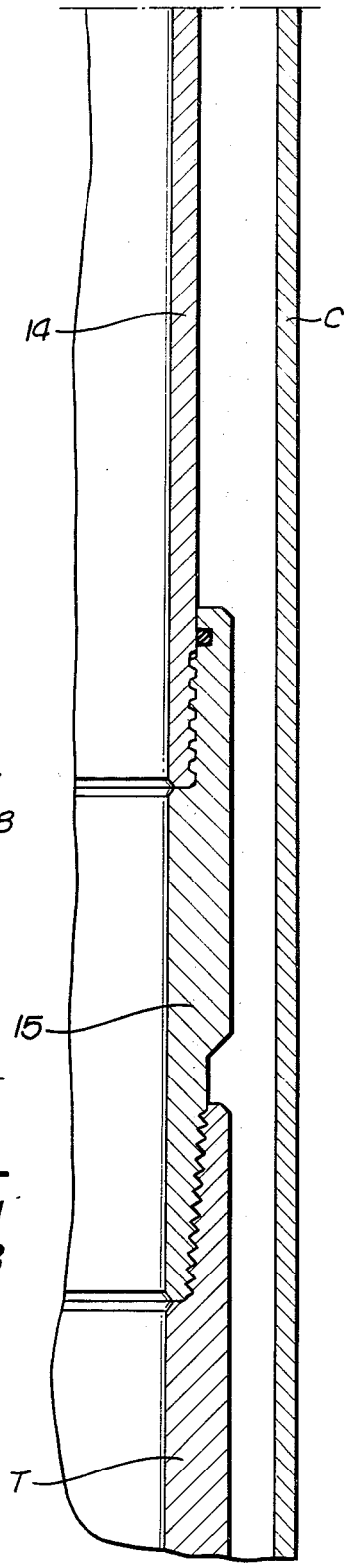

FIG. 8 is a cross-section taken along the line of 8—8 on FIG. 1g;

FIG. 9 is a cross-section taken along the line 9—9 on FIG. 6b; and

FIG. 10 is a cross-section taken along the line 10—10 on FIG. 6b.

A well packer embodying the invention is adapted to be lowered through a string of well casing C disposed in a well bore on a tubular string S to a setting location at which the packer is to be anchored in packed-off condition against the casing. The packer includes a main body structure 10 including a top body sub 11 threadedly secured to the lower end of an adjacent section of the tubular string S, this sub being threadedly secured to an upper body section or mandrel 12, the lower end of which is threadedly attached to a body connector 13 that is threadedly secured to a lower body section or mandrel 14, the lower end of which is threadedly attached to a bottom body sub 15 threadedly attached to the upper end of a tubular section T depending therefrom.

The body or mandrel 10 is anchored to the wall of the well casing against longitudinal movement in both directions. The anchoring means A includes a lower cone or expander 16 releasably attached to the body section 14 by a left-hand threaded interconnection 17, release being initially prevented by means of one or more shear screws or pins 18 threaded into the expander and extending into a peripheral groove 19 in the body. This lower expander has upwardly and inwardly tapering expander surfaces 20 coacting with companion tapered surfaces 21 on the lower portion of a set of circumferentially spaced lower slips 22, the upper ends of which are connected by slidable I-shaped heads 23 to a slip ring 24 surrounding the body, the lower slips having peripheral teeth or wickers 25 adapted to partially embed themselves in the casing wall.

Figure 2A:
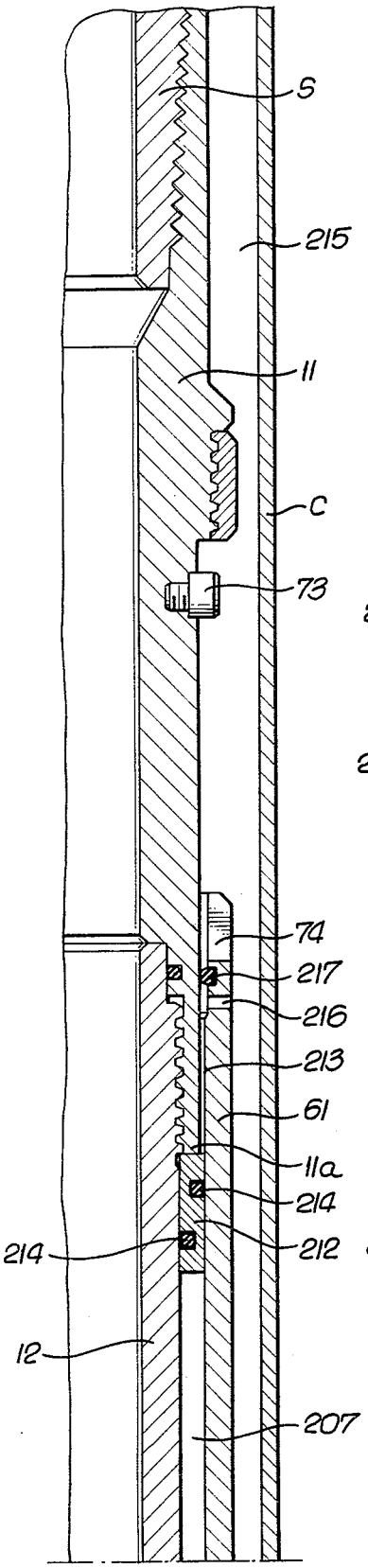
Figure 2B:
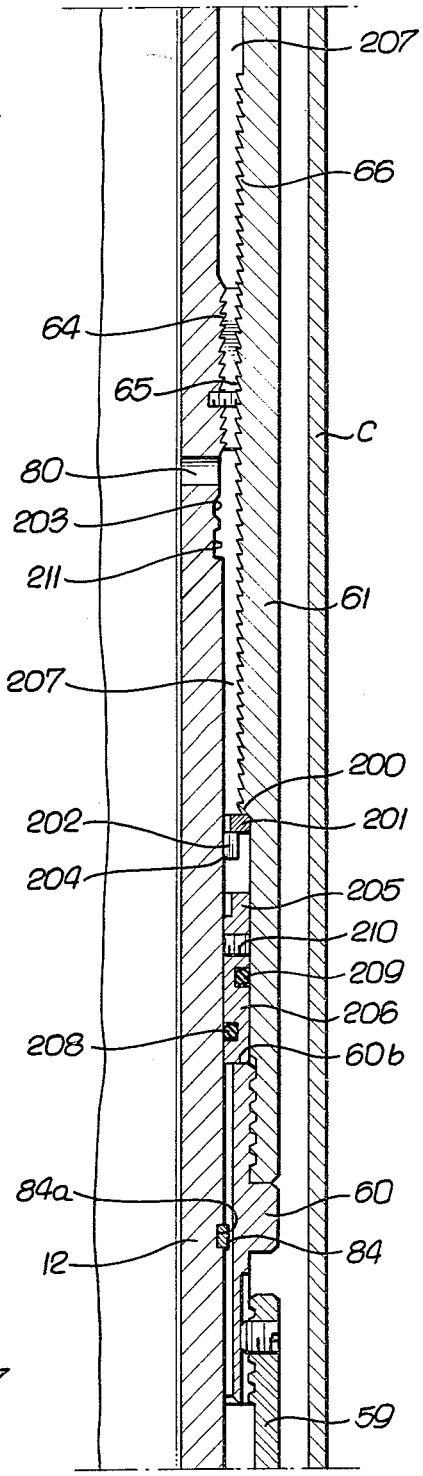
Figure 2C:
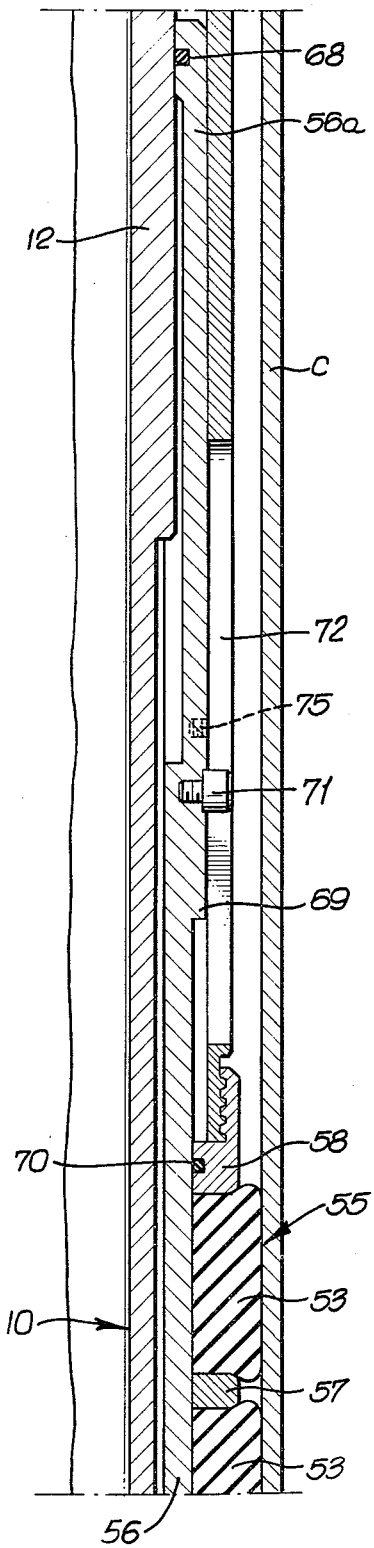
Figure 2D:
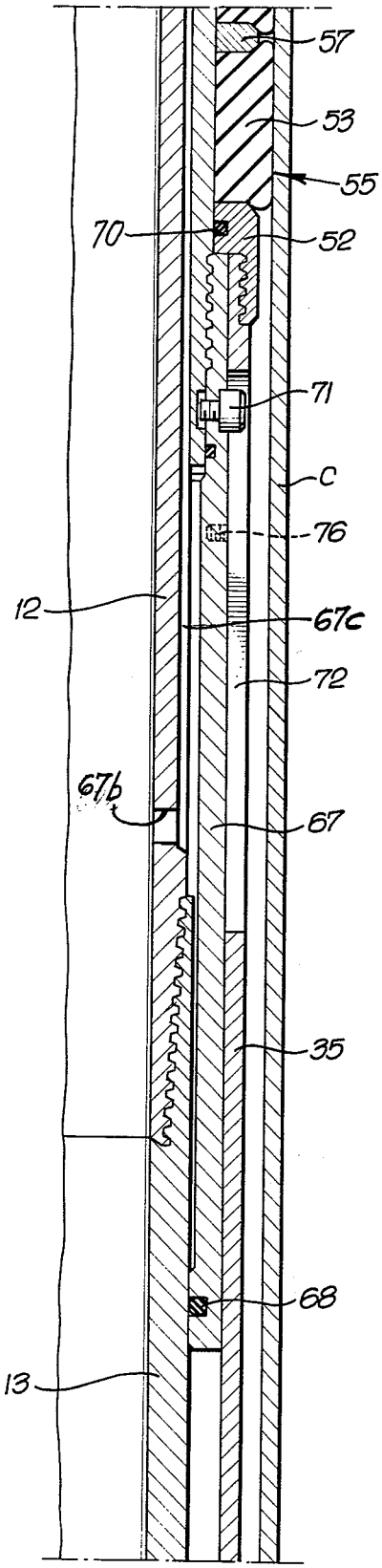

The anchoring means A further includes circumferentially spaced upper slips 26, the lower T-shaped heads 27 of which are radially slidably disposed in companion T-shaped grooves 28 in the upper portion of the slip ring 24. These slips have inner surfaces 29 (FIG. 2f) tapered in an upward and outward direction and engaging campanion tapered surfaces 30 on the lower portion of an upper cone or slip expander 31 adjustably and threadedly attached to a spacing sub 32 surrounding the body, which is connected by inter-engaging threads 33 with a support mandrel 34 surrounding the body and extending upwardly into a support sleeve 35.

When the well packer is being lowered in the well casing, the body or mandrel 10 is locked to the support mandrel 34 to prevent relative movement therebetween. As specifically disclosed (FIG. 1f), the upper portion of the support mandrel is formed as a collet 36 having spring-like lower arm portions 37 and upper finger portions 38, a downwardly facing shoulder 39 on the body engaging the upper ends of the fingers 38 which surround a reduced diameter retainer portion 40 of the body connector 13, which thereby holds the fingers outwardly in a position immediately above a downwardly tapering shoulder 41 on the support sleeve 35 such that downward movement of the body is transmitted through the shoulder 39 to the fingers 38 and from the fingers to the support sleeve.

The support sleeve 35 is prevented from moving downwardly with respect to the support mandrel 34 by a split body lock ring 42, of a known type, which has internal downwardly facing wickers or ratchet teeth 43 engaging upwardly facing companion wickers or ratchet teeth 44 on the support mandrel. The body lock ring does not restrict relative upward movement of the support sleeve with respect to the support mandrel because of the ability of the body lock ring 42 to expand and ratchet relatively freely upwardly along the support mandrel ratchet teeth 44. External cam teeth 46 of the support sleeve cam the body lock ring inwardly and maintain the ratchet teeth coengaged in the event the support sleeve 35 tends to move downwardly relative to the support mandrel. However, the support sleeve 35 can shift upwardly and carry the body lock ring 42 with it with respect to the support mandrel, because of the ability of the body lock ring, which is a split member, to expand outwardly to disengage the ratchet teeth 43, 44 from one another. There is sufficient radial clearance between the cam teeth 45, 46 on the body lock ring and on the support sleeve to permit outward expansion of the body lock ring relative to the support mandrel.

A split body lock ring 47 is also provided between the lower portion of the support mandrel 34 and the body section 14, which will permit the support mandrel 34 to be moved downwardly relative to the body but not upwardly. As disclosed in FIG. 1g, the body lock ring has upwardly facing internal ratchet teeth 48 adapted to mesh with downwardly facing external ratchet teeth 49 on the body, coengaging cam teeth 50, 51 being on the exterior of the body lock ring and the support mandrel. Although relative downward movement of the support mandrel 34 on the body is permitted, because of the downward ratcheting of the internal teeth 48 along the external body ratchet teeth 49, reverse motion cannot take place, since the cam teeth 50, 51 will force and retain the internal ratchet teeth 48 in coupling engagement with the body ratchet teeth 49.

The support sleeve 35 extends upwardly around the body, its upper end being threadedly secured to a lower gage ring 52, engaging the lowermost packing element 53 of a packing assembly 55, the gage ring also being relatively slidable along an upper booster sleeve 56, disposed within the packing elements 53. The packing elements, which are normally retracted and made of rubber or rubber-like material, are separated from each other by spacer rings 57. The upper end of the uppermost packing element 53 engages an upper ring 58 threadedly secured to an upper pack-off sleeve 59, the upper end of which is threadedly attached to an adjusting sub 60, which is, in turn, threadedly secured to the lower end of a setting sleeve 61 extending upwardly along the body and its top sub 11. Another split body lock ring 62 is disposed between the upper body or mandrel section 12 and the setting sleeve 61 which will permit downward movement of the setting sleeve relative to the body, but prevent upward movement of the setting sleeve relative to the body. As disclosed in FIGS. 1b, 1c, the body lock ring 62 has internal cam teeth 63 engaging companion cam teeth 64 on the body, external downwardly facing ratchet teeth 65 in the ring engaging companion upwardly facing ratchet teeth 66 in the setting sleeve. Sufficient clearance exists between the cam teeth such that the lock ring 62 can contract inwardly to permit the setting sleeve 61 to ratchet downwardly along the lock ring. However, any tendency for the setting sleeve to move upwardly is prevented by the relocking engagement of the ratchet teeth 65, 66 with one another.

A lower booster sleeve 67 is threadedly secured to the upper booster sleeve 56, being disposed in the annular space between the body and support sleeve 35. The lower portion of the sleeve 67 carries a seal ring 68 slidably sealing against the periphery of the body connector 13, the upper end of the sleeve 67 being adapted to bear against the lower gage ring 52. The upper portion 56*a* of the upper booster sleeve 56 carries a seal ring 68 slidably sealing against the periphery of the upper body section 12 and has a downwardly shoulder 69 adapted to engage the upper gage ring 58 to exert a downward force thereon, as described hereinafter. The upper and lower gage rings carry seal rings 70 for slidably sealing against the periphery of the upper booster sleeve. To vent the region between the booster sleeves 56, 67 and the body section 12, a hole 67*b* extends through the body section 12 which opens into an elongate groove 67*a* into body section 12.

The upper and lower booster sleeves 56, 67 are prevented from rotating relative to the pack-off sleeve 59 and the support sleeve 35 by a cap screw 71 on each of the booster sleeves fitting within an elongated slot 72 in each of the sleeve 59 and 35. However, as described hereinbelow, relative longitudinal movement can occur between the upper pack-off sleeve 59 and the upper booster sleeve 56, and also between the lower booster sleeve 67 and the support sleeve 35.

The setting sleeve 61 is initially prevented from moving downwardly relative to the body 10 by sleeve shoulder 200 engaging a stop ring 201 resting upon a segmental ring 202 fitting within a body groove 203 having upper and lower tapered sides 204. The segments 202 are retained in the groove by the upper portion 205 of an annular setting piston 206 disposed in an annular cylinder 207 defined between the body and setting sleeve, leakage of fluid past the piston being prevented by inner and outer seal rings 208, 209. One or more shear screws 210 threaded in the piston extend within a body groove 211 to hold the piston initially in its upward position to retain the segments 202 in the groove 203.

It is to be noted that an annular compensating piston 212 is disposed in the annular space 213 between the body and setting sleeve 61. Seal rings 214 on the piston engage the body and sleeve to prevent fluid leakage past the piston which forms the upper end of the cylinder 207 and enables fluid pressure to be built up in the cylinder 207, as described hereinbelow. The fluid pressure in the tubing casing annulus 215 can be imposed on the compensating piston 212 by passing through a port 216 in the upper end of the sleeve 61 into the space 213. Foreign matter is prevented from entering the space 213 by a seal ring 217 in the setting sleeve 61 engaging the periphery of the body.

Relative rotation between the body and the setting sleeve 61 is initially prevented by a set screw 73 threadedly secured to the top body sub 11 and engaging within an upwardly opening slot 74 in the upper end portion of the setting sleeve. Relative movement between the upper pack-off sleeve 59 and the upper booster sleeve 56 is prevented initially by one or more shear pins 75 interconnecting these two members. Relative movement between the lower booster sleeve 67 and the support sleeve 35 is initially prevented by one or more shear pins 76 interconnecting these two members. In view of the various interconnections between the parts, the setting sleeve 61 cannot move downwardly with respect to the body 10 since any downward force imposed on the setting sleeve will be transmitted through the stop ring 201 and segments 202 to the body 10. Similarly, any force tending to move the support sleeve 35 upwardly with respect to the body is precluded by the transmission of such force from the tapered shoulder 41 through the collet fingers 38 to the downwardly facing shoulder 39 on the body connector 13. In turn, because of the shouldered engagement of the upper and lower gage ring 58 and 52 with the upper and lower booster sleeves 56 and 67, the setting sleeve 61, adjusting sub 60, and upper pack off sleeve 59 are restrained by the support sleeve 35, acting through the booster sleeves, from moving upwardly, and, conversely, the support sleeve 35 is similarly restrained by the setting sleeve 61, through the same interconnecting parts, from moving downwardly.

The support mandrel 34 prevents the upper slip expander 31 from shifting downwardly of the body in view of the engagement of the fingers 38 with the companion shoulder 41 on the support sleeve 35. The lower expander 16 cannot move upwardly of the body in view of its threaded connection 17 to the body. Since none of the external parts of the packer can move with respect to each other, the slips 22, 26 and the packing elements 53 remain in their retracted positions. External forces imposed on the external parts cannot prematurely expand the slips or the packing elements against the casing, such as forces resulting from dragging of the packer against the casing wall or by pushing of the packer through tight spots or around dog legs in the casing string.

Figure 2E:
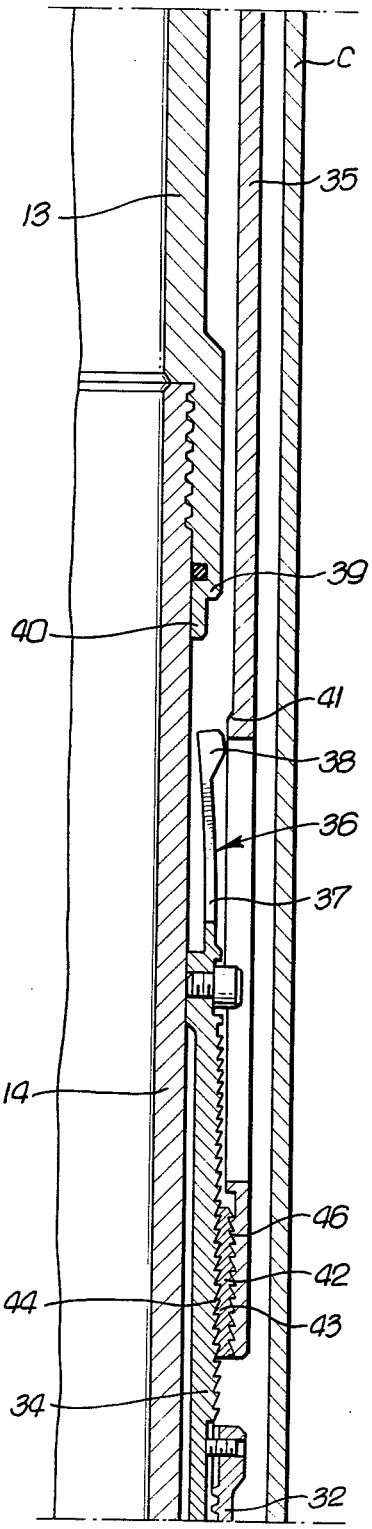
Figure 2F:
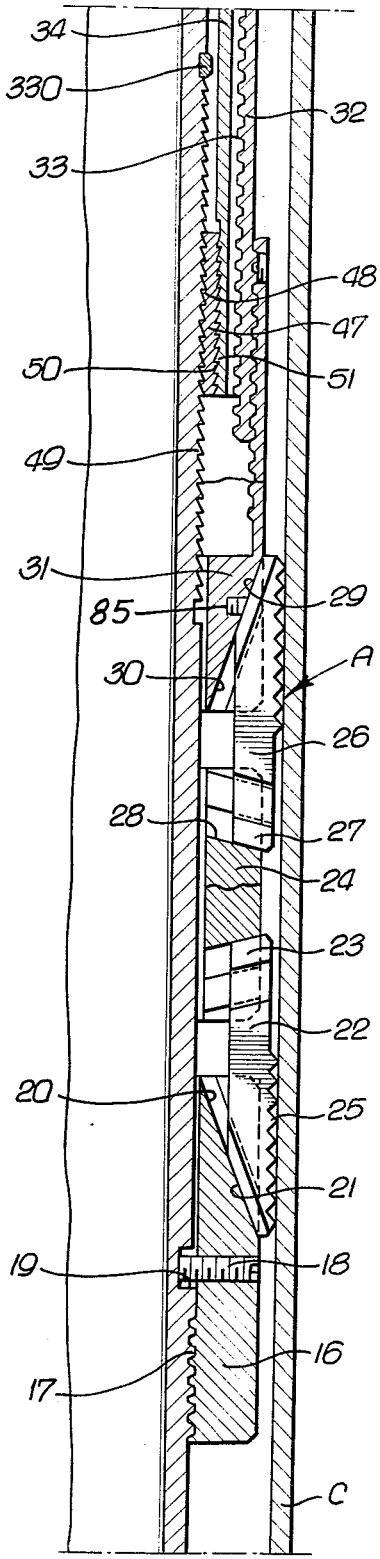
Figure 2G:
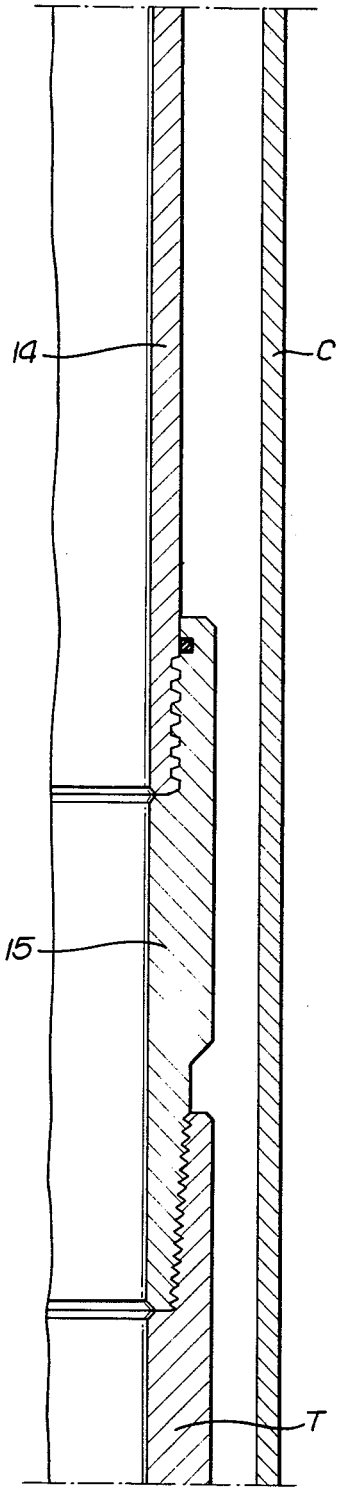
Figure 2H:
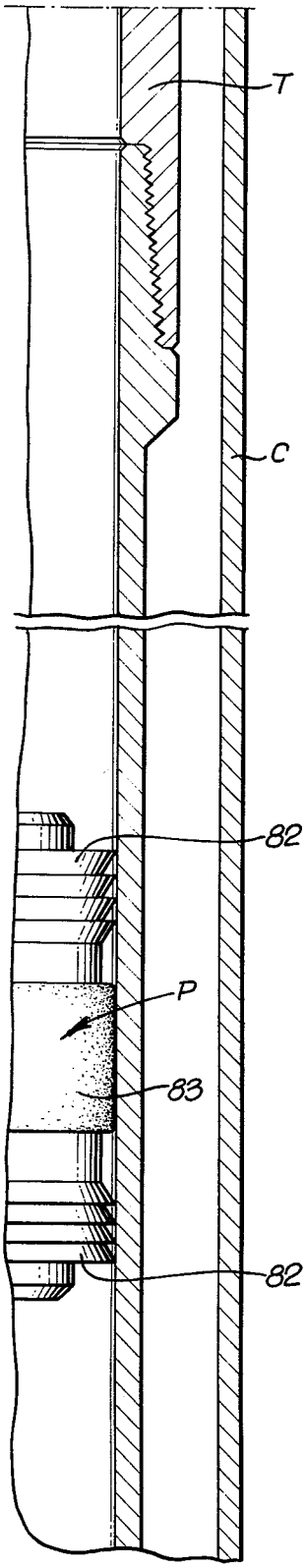
Figure 3A:
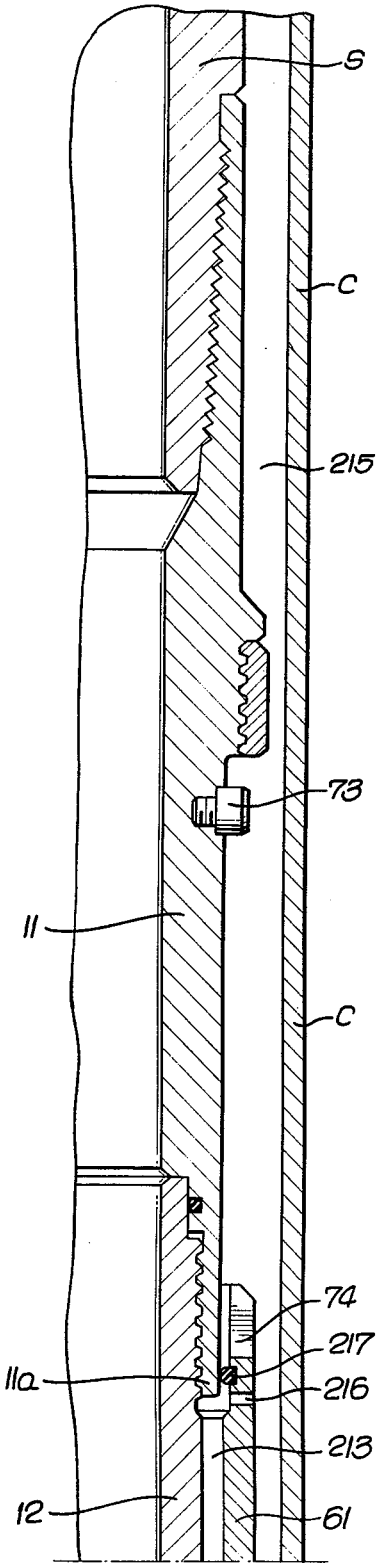
Figure 3B:
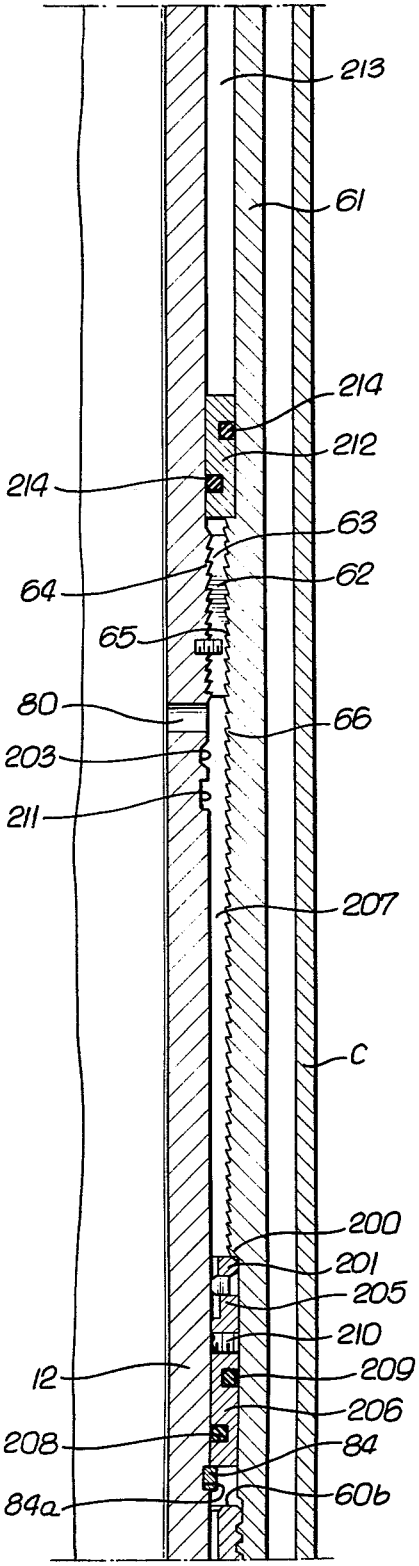
Figure 3C:
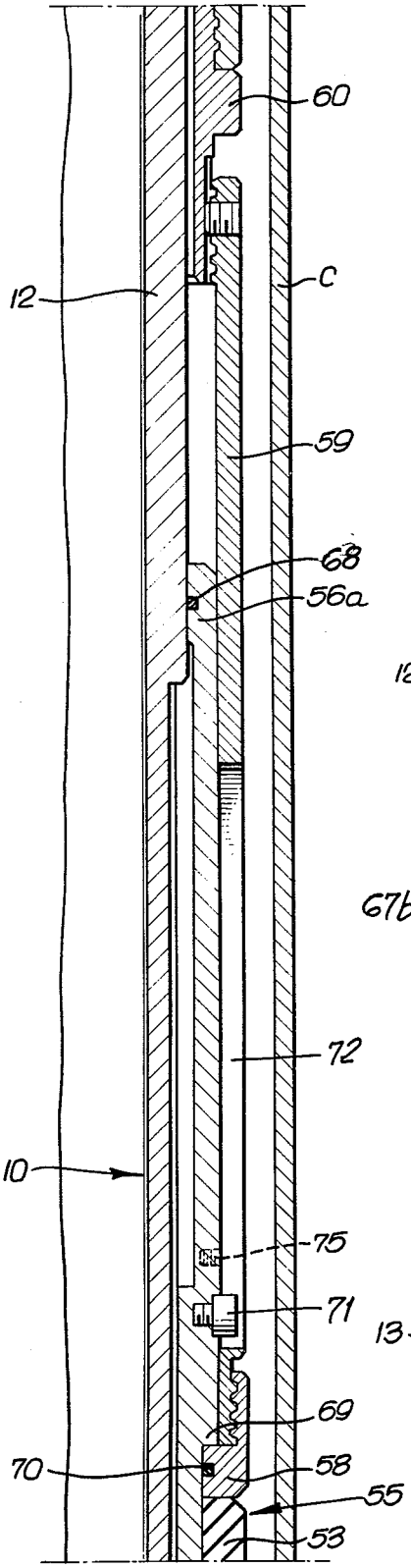
Figure 3D:
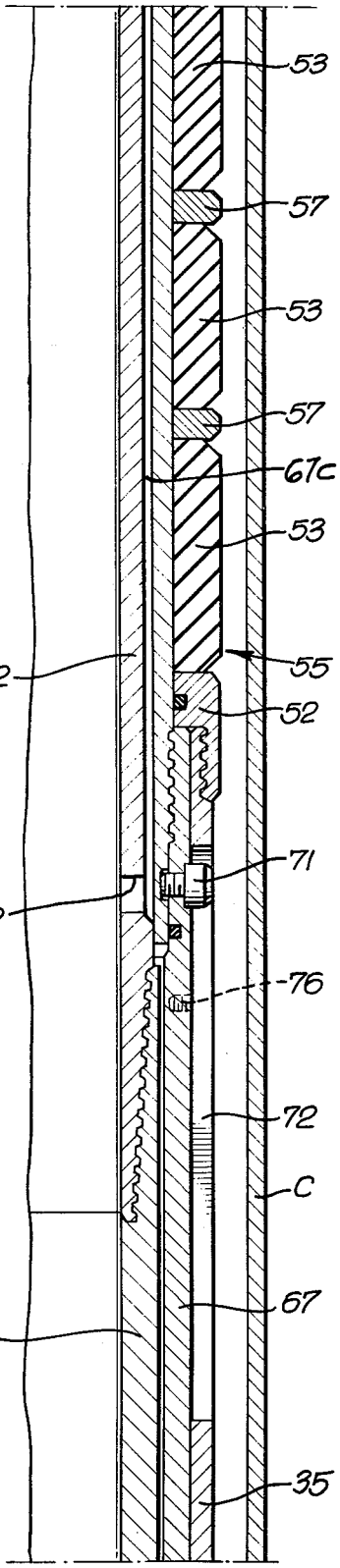
Figure 3E:
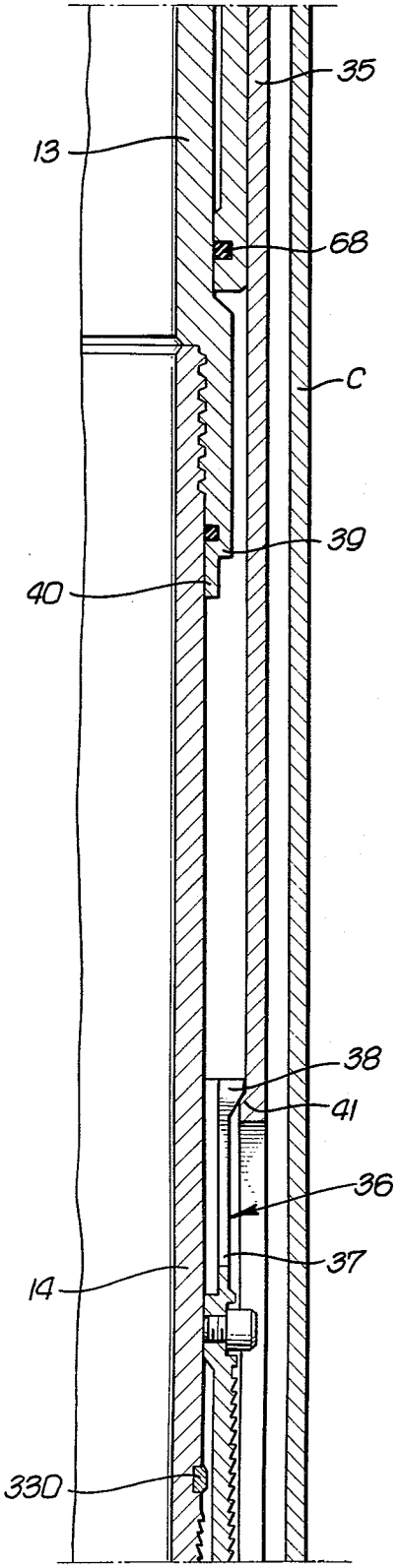
Figure 3F:
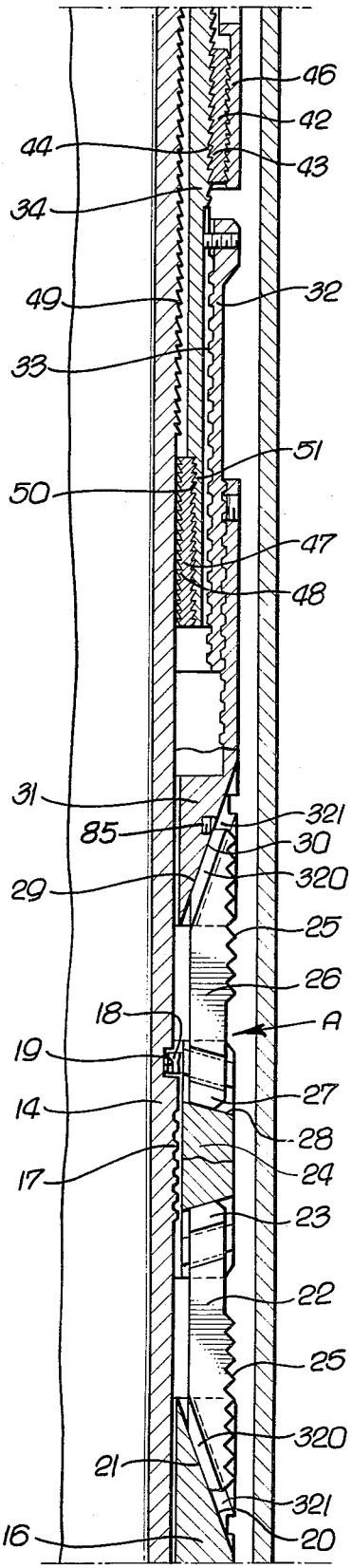
Figure 3G:
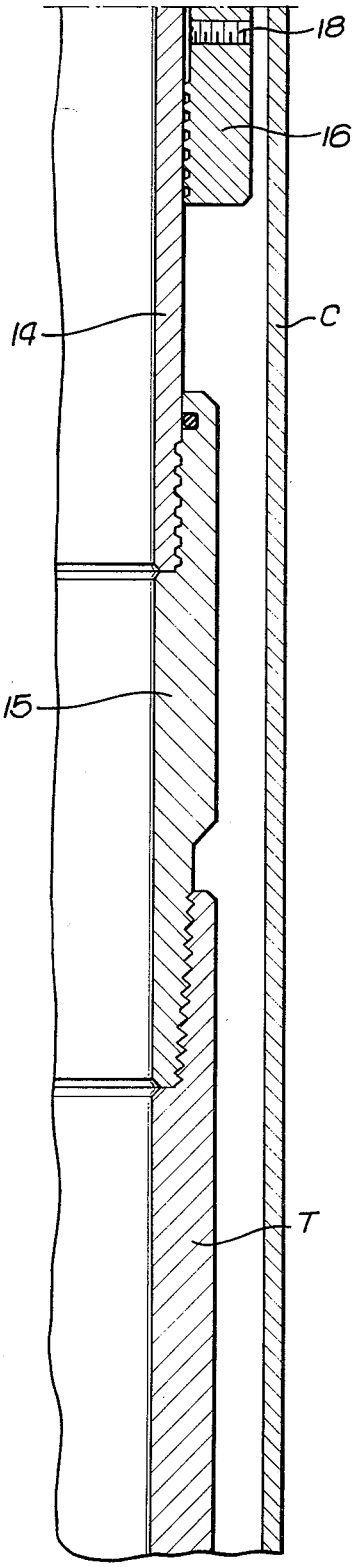

Fluid under pressure can pass through one or more body ports 80 into the annular space 207 between the setting sleeve 61 and the upper body 12 above the setting piston 206, this fluid also being able to pass into the annular space 213 between the upper body 12 and setting sleeve 61 and below the compensating piston 212. Such fluid pressure can be developed upon the lowering of a suitable plug P through the tubular string into the section tubing T below the lower end of the packer (FIG. 2*h*). Such plug is shown diagrammatically in the drawings and may be a plug of the retrievable type adapted to be lowered into position and set on a wire line, all in a known manner. As disclosed, the plug P has upper and lower slips 82 and an intervening packing 83 so as to be incapable of moving within the tubular string after having been set there within.

As disclosed, a pick-up ring 84 is mounted in a groove 84*a* in the upper body mandrel 12, which comes into play in connection with the retrieving of the packer from the well bore.

Shear pins or screws 85 are secured to the upper expander 31, being disposed immediately above the upper ends of the upper slips 26 to prevent relative downward movement of the upper expander with respect to the upper slips until after the lower slips 22 have been expanded outwardly into anchoring engagement with the casing.

The well packer is connected to the tubular string S and is lowered into the well casing to the desired setting point, the parts occupying the relative positions disclosed in FIGS. 1*a* to 1*h,* inclusive. As described above, the parts cannot move relative to one another to prematurely set the slips or to expand the packing elements into sealing engagement with the wall of the well casing. A suitable retrievable plug P, or the like, is lowered as on a wire line through the tubular string and the body 10 into a lower tubing section T, this plug being anchored in packed-off condition against the wall of such section, thereby closing the bore of the well packer.

Pressure can now be built up in the fluid in the tubing string and body, such pressure being exerted through the port 80 upon the setting piston 206 urging it in a downward direction. When the force developed by the pressure exceeds the shear strength of the screws 210, they are disrupted, the setting piston moving downwardly into engagement with the upper end 60*b* of the adjusting sub 60. This action also removes the setting piston from encompassing the segments 202, which can then shift laterally outwardly out of the body groove 203, and thereby releases the restraint preventing the setting sleeve 61 from moving downward with respect to the packer body 10. The fluid pressure is also effective to shift the compensating piston 212 upwardly into engagement with the lower end 11*a* of the top body sub 11.

Since the setting sleeve 61 is now unlocked from the body, it is pulled downward through its connection to the adjuster sub 60 which in turn is being urged downward by the setting piston 206. As the adjuster sub moves downwardly, it pushes ahead of it, as a unit, the upper pack off sleeve 59, the upper booster sleeve 56, the lower booster sleeve 67 and the support sleeve 35, because these parts are all interconnected either with mating threads or with the shear screws 75 and 76. The downward movement of the support sleeve 35 carries the support mandrel 34 downwardly with it, because of the fact that the body lock ring 42 is coupled to the support mandrel through the interengagement of the ratchet teeth 43, 44 which shifts the collet fingers 38 downwardly below the retaining portion 40 of the body (FIG. 2*e*). The spacing sub 32 and the upper expander 31 also move downwardly with the support mandrel, since they are threadedly secured to one another, the downward movement of the expander 31 being transmitted through the shear pins 85 to the upper slips 26 and to the slip ring 24, which will then shift the lower slips 22 downwardly along the lower expander 16 to expand the lower slips outwardly into anchoring engagement with the wall of the well casing.

The shear pins 85 fixed to the upper expander 31 have a lower shear value than the shear pins 76, 75 attaching the support sleeve 35 to the lower booster sleeve 67 and the upper pack-off sleeve 59 to the upper booster sleeve 56. Accordingly, after expansion of the lower slips 22 against the casing the upper expander shear pins 85 are disrupted, the upper expander 31 then moving downwardly along the upper slips and expanding them laterally outwardly into anchoring engagement to the well casing. The lower slips 22 will prevent upward movement of the packer body 10 with respect to the well casing, whereas the upper slips 26 will prevent downward movement of the packer body with respect to the well casing. Downward movement of the body relative to the upper expander is prevented by the engagement of the body ratchet teeth 49 with the companion teeth 48 of the body lock ring 47, which results in any tendency of the body to move downwardly to produce downward shifting of the upper expander 31 relative to the body and firmer anchoring of the lower slips against the casing.

A further increase in the pressure of the fluid in the body will exert a sufficiently great force upon the adjusting sub 60, upper pack-off sleeve 59, upper booster sleeve 56, lower booster sleeve 67, and support sleeve 35 as to effect shearing of the pins 75, 76 securing the support sleeve to the lower booster sleeve and the upper booster sleeve to the upper pack-off sleeve. Since the support sleeve 35 cannot move downwardly relative to the upper expander 31, which is anchored through the upper slips 26 against the well casing, the upper pack-off sleeve 59 can shift downwardly toward the immovable support sleeve 35 to shorten and compress the packing elements 53 and expand them outwardly into firm sealing engagement with the wall of the well casing (FIGS. 2*c,* 2*d*). The pressure applied to the setting piston 206 is increased to a predetermined degree to insure the firm anchoring engagement of the slips 22, 26 against the wall of the well casing and the compression of the packing elements 53 to insure they effect a leak-proof seal against the casing wall and also against the periphery of the upper booster sleeve 56. The parts are then in their fully anchored and packed-off positions as disclosed in FIGS. 2*a* to 2*h* of the drawings. A fluid pressure differential in the annulus above the packing elements is prevented from leaking downwardly past the packing elements, whereas a fluid pressure differential from below the packing assembly is prevented from leaking upwardly past the packing elements.

The upper setting sleeve 61 is free to ratchet downwardly along the body lock ring 62 in effecting compression of the packing elements 53 and their being placed in a packed-off condition against the periphery of the upper booster sleeve 56 and the inner wall of the well casing C. This setting sleeve cannot shift upwardly relative to the body since its internal ratchet teeth 66 will interengage with the body lock ring ratchet teeth 65. In other words, the setting sleeve 61 can shift in a downward direction only along the body 10.

Figure 4:
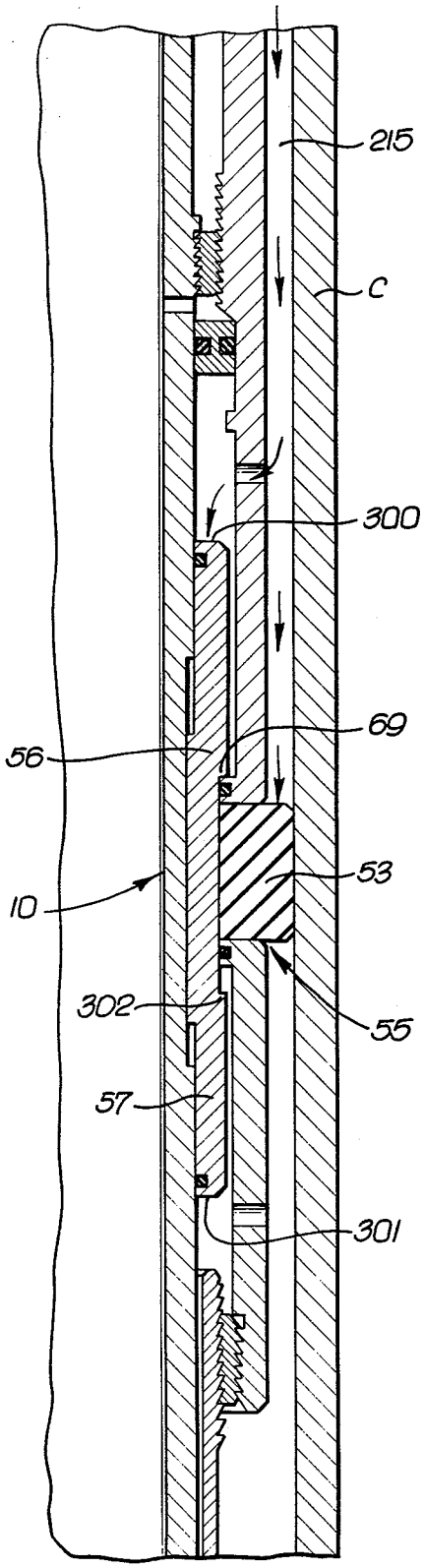
FIG. 4 is a quarter longitudinal section disclosing diagrammatically the action of a fluid pressure differential in the tubing-casing annulus above the packing element in boosting the compressive force expanding the packing element against the well casing.

The pressure differential in the tubing-casing annulus 215 above the packing 55, as well as the pressure differential between the packer body and the casing wall below the packing 55, are effective to apply a greater compression force to the packing elements 53. As disclosed diagrammatically in FIG. 4, the pressure differential above the packing elements 53 in the tubing-casing annulus can act downwardly on the elements to further actually compress them, and also over an end area 300 of the upper booster sleeve 56 to engage its downwardly facing shoulder 69 with the upper gage ring 58 and exert an additional compressive force on the packing elements. This additional compressive force is proportional to the end area 300 and the pressure acting on it. The area is therefore made large enough so that the force exerted will supplement the compressive force of the pressure acting on the elements to a degree to always maintain them in leak-proof sealing engagement with the casing wall, regardless of the pressure differential across them. In other words, the packing elements in conjunction with the booster sleeve may be said to be self-energized by the pressure differential.

Figure 5:
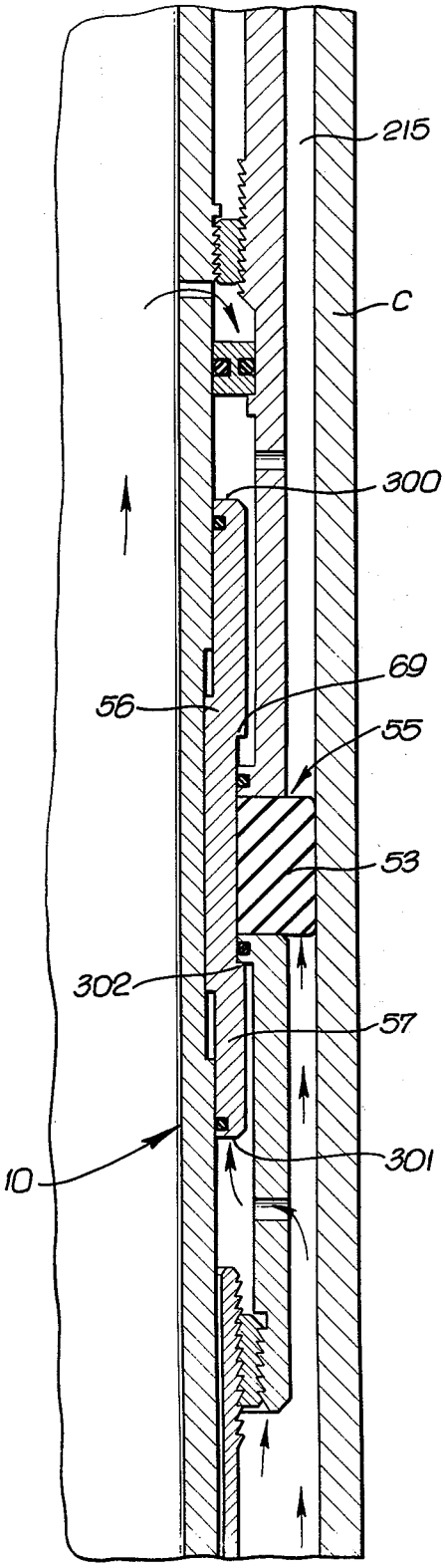
FIG. 5 is a view similar to FIG. 4 disclosing diagrammatically the action of a pressure differential in the annular space surrounding the well packer below the packing element in applying a booster or increasing force on the packing element to further compress it and holds it expanded in sealed relation against the well casing.

Similarly, as disclosed in FIG. 5, the pressure differential in the annulus below the packing assembly 55 acts upwardly over the end area of the expanded packings 53 and also over the end area 301 of the lower booster sleeve 57 to force its shoulder 302 against the lower gage ring 52 and the latter against the end of the lower packing element 53. Here again, the pressure differential is acting over an effective area corresponding to the distance between the periphery of the packer body and the casing wall to exert a greater force against the ends of the packings 53 to compress them more firmly into sealing engagement with the periphery of the booster sleeve 56 and the inner wall of the casing.

Assuming that the additional packing force imparted to the packing elements results in further downward movement of the upper pack-off sleeve 59 and the setting sleeve 61 relative to the body 10, such parts are locked in the new position, since the setting sleeve will ratchet past the lock ring 62, as permitted by the ratchet teeth 65, 66, but they cannot move upwardly with respect to the body due to the coengagement of the ratchet teeth 65, 66. The setting sleeve and the pack-off sleeve are, therefore, locked in their new position holding the packing elements 53 in compressed and sealing engagement with the periphery of the booster sleeve 56 and the wall of the well casing. In a similar manner, any additional upward movement of the lower booster sleeve 57 and support sleeve 35 with respect to the body is permitted since the body lock ring 42 can ratchet upwardly along the ratchet teeth 44 of the support mandrel 34, which is prevented from moving upwardly by the engagement of the ratchet teeth 48 on the body lock ring 47 with the downwardly facing ratchet teeth 49 on the packer body.

A pack-off system has been provided which is always self-energizing, since any additional compression imposed by the fluid pressure above the packing elements 53, results in downward movement of the upper pack-off sleeve 59, adjusting sub 60 and setting sleeve 61 relative to the body, such parts being prevented from moving relatively upwardly of the body by the one-way or ratchet device 62 between the setting sleeve and the packer body. With respect to increased pressure from below effecting a further packoff of the packing elements 53 against the casing, the accompanying upward movement of the support sleeve 35 relative to the body is permitted by the upward ratcheting of the body lock ring 42 along the ratchet teeth 44 of the support mandrel 34, downward or reverse movement of the support sleeve 35 being prevented by the interengagement between the ratchet teeth 43, 44. Thus, the energy imparted to the packing elements is trapped by the ratchet system, including the body lock rings 62, 42.

After the well packer has been fully set in the casing, the plug P is removed to fully open the central passage through the packer body 10.

It is to be noted that the downward shifting of the setting sleeve 61 in effecting setting of the packer has removed the upper groove portion 74 of the setting sleeve below the body cap screw 73, which enables the body 10 to be rotated with respect to the parts that surround it, including the expanders 16, 31 and slips 22, 26. The slips, being anchored to the well casing, cannot rotate, which is also true of the upper and lower expanders coupled to the slips. Accordingly, the tubular string S and the body or mandrel 10 connected thereto can be rotated with respect to the well packer portions surrounding the body, the torque transmitted to the body effecting shearing of the screw 18 holding the lower expander 16 to the body. Since the lower expander is prevented from rotating by the anchoring engagement of the lower slips 22 against the wall of the well casing, continued rotation of the tubular string S and body 10 in a right-hand direction will effect downward unthreading of the lower expander from the body 10 because of the left-hand threaded interconnection 17 between the expander and body, the lower expander dropping downwardly along the body (FIGS. *3f, 3g*). Because of the inclined slidable tongue and groove interconnection 320, 321 between the lower expander and lower slips, downward shifting of the lower expander 16 will retract the lower slips 22 from the casing. The continued downward force imposed on the lower expander 16, lower slips 22, and slip ring 24 by gravity will also exert a downward pull on the upper slips 26, retracting them from the casing because of the slidable tongue and groove interconnection 320, 321 between the upper slips and the upper expander.

The upper expander 31 and the slips 26, 22 and lower expander 16, and the parts thereabove, can continue to move downwardly along the body since the body lock ring 47 is free to ratchet in a downward direction along the body 10. The support mandrel 34 can also move downwardly since the tapered shoulder 41 on the support sleeve 35 will have flexed the unrestrained fingers 38 and the collet arms 37 in an inward direction, until the support mandrel 34 comes to rest on a snap ring 330 secured to the body 10. The support sleeve 35 can drop downwardly of the body, its lower gage ring 52 shifting the lower booster sleeve 67 and upper booster sleeve 56 downwardly with it to relieve the compression on the packing elements 53 to permit them to contract inherently to their initial position free from engagement with the wall of the well casing. The upper pack-off sleeve 59, adjusting sub 60, and setting sleeve 61 can drop downwardly along the body, limited by engagement of the setting piston 206 with the pick-up ring 84 mounted on the upper body section 12, the setting sleeve coming to rest against the stop ring 201 and segments 202 disposed above the setting piston.

The parts are now in the position illustrated in FIGS. *3a* and *3g*. The released packer can now be elevated through the casing to the top of the well bore.

Another type of release mechanism can be embodied in the packer, in which the lower expander **16*a* is not threaded to the lower body section 14**. As disclosed in FIGS. *6a* and *6b*, the lower expander is initially secured indirectly to the lower body by threadedly connecting the lower expander to an expander support sleeve 400 having internal threads 401 in its lower end portion which threadedly engage threaded fingers 402 of a collet 403 mounted on a lower coupling 404 threadedly secured to the lower end of the lower body 14 (FIGS. *6b*, 9, 10). Collet arms 405 extend upwardly through external longitudinal grooves 406 in the body coupling 404, the upper circumference continuous portion 407 of the collet resting upon the upper end of the lower coupling 404, as disclosed in FIG. *6b*. The bottom portion of the lower body coupling is connected to a bottom body sub 15, which is, in turn, threadedly secured to the tubing string section T therebelow.

The threaded fingers 402 are retained initially in coupled engagement with the lower threads 401 of the expander support sleeve by a retaining and release sleeve 410 mounted within the body coupling 404. The intermediate portion **410*a* of the release sleeve is of larger external diameter than the upper portion 410*b* of the release sleeve to hold the threaded fingers 402 coupled to the expander support sleeve. Downward movement of the release sleeve 410 is initially prevented by its engagement with one or more shear screws 412 threaded in the coupling 404 and underlying a downwardly facing shoulder 413 on the release sleeve, the latter extending downwardly and being piloted within the bottom body sub 15**.

The lower slips 22 are set in the same manner as described above in connection with FIGS. 1 to 3, since the lower expander **16*a* is secured to the body by the expander support sleeve 400, collet fingers 402, coupling 404, and release sleeve 410, and the fact that the collet rests upon the upper end of the lower coupling 404. When the packer is to be released and retrieved, a suitable releasing tool 420 is secured to a suitable running tool 421 and run in the tubular string S and through the body 10 on a wire line (not shown). The running tool 421 can be of any suitable and known type, such as the Type "GS" Otis Running and Pulling Tool, disclosed on page 3988 of the 1974–1975 Composite Catalogue of Oil Field Equipment and Services. The dogs 422 of such tool are received within an internal groove 432 in the body 424 of the releasing tool, the lower end of which has a guide 425 secured thereto. A stop sleeve 426 is mounted on the body by means of shear screws 427, the lower end of this body being adapted to come to rest upon a shoulder 428 on the lower body coupling 404, at which time the lower dogs 429 of a collet 430 will be located opposite an internal groove 431 of the release sleeve 410, the dogs 429 being in a retracted position and initially being supported by the stop sleeve 426 by plurality of shear screws 432 secured to the stop sleeve and resting under a shoulder 433 on the upper portion of the collet. A downward force can now be imposed through the running tool 421 and its dogs 422 on the body 424, shearing the upper screws 427 securing the body to the stop sleeve 426, the body 424 shifting downwardly so that its expander portion 440 will engage the companion tapered expander portion 429***a* of the dogs 429 and shift the latter outwardly into the release sleeve groove 431, downward movement of the body 429 continuing until longitudinal retainer surfaces 441 on the body are disposed behind companion internal surfaces 442 on the dogs, to firmly secure the dogs in their outward position within the release sleeve groove 431, coupling the dogs 420 to the sleeve 410 (FIG. 7*b*).

The running tool 421 and releasing tool body 424 coupled thereto are then jarred in a downward direction, which will shear the screws 432 connecting the collet 430 to the stop sleeve 426 and also shear the screws 412 supporting the release sleeve 410 in its upper position, as disclosed in FIG. 6*b*, the release sleeve shifting downwardly to a position in which the small diameter or upper portion 410*b* of the release sleeve is disposed opposite the threaded fingers 402 of the collet 403. The collet fingers can retract inherently inwardly out of threaded engagement with the expander support sleeve 400, allowing the latter and the lower expander 16*a* to drop downwardly along the packer body 10, effecting retraction of the slips 22, 26 and of the packing elements 53 from the well casing, in the same manner described in connection with FIGS. 1–3, inclusive. The lower portion of the packer and the release mechanism then occupy the relative positions disclosed in FIGS. 7*a* and 7*b*.

An upward pull taken through the wire line (not shown) on the running tool 421 will then effect upward movement of the releasing tool body elevating the body 424 with respect to the dogs 429 and locate a reduced diameter portion 450 of the body opposite the dogs, permitting the dogs 429 to be retracted inwardly out of the release sleeve groove 431, whereupon the running tool 421 and releasing tool 420 can be elevated by the wire line through the body 10 of the well packer and tubular string S to the top of the well bore. The well packer can now be retrieved from the well casing by elevating the tubing string S and the packer body 10 in the same manner described in connection with the specific embodiment illustrated in FIGS. 1–3, inclusive.

I claim:

1. A well tool adapted to be lowered in a well conduit disposed in a well bore, comprising body means, expander means on said body means, normally retracted slip means coacting with said expander means, normally retracted packing means on said body means, actuating means on said body means for effecting relative longitudinal movement between said expander means and slip means to expand said slip means into anchoring engagement with the well conduit, said actuating means including means movable downwardly of said body means for expanding said packing means against the well conduit, and releasable means for preventing said actuating means from expanding said packing means against the well conduit until said slip means have first been expanded against the well conduit.

2. A well tool adapted to be lowered in a well conduit disposed in a well bore, comprising body means, expander means on said body means, normally retracted slip means coacting with said expander means, normally retracted packing means on said body means, actuating means on said body means for effecting relative longitudinal movement between said expander means and slip means to expand said slip means into anchoring engagement with the well conduit, said actuating means including means for expanding said packing means against the well conduit, and releasable means for preventing said actuating means from expanding said packing means against the well conduit until said slip means have first been expanded against the well conduit; said packing means being above said slip means and including one or more elastomer packing elements, said actuating means including upper sleeve means engaging the upper end of said one or more elements, lower sleeve means engaging the lower end of said one or more elements, and intermediate sleeve means between said upper and lower sleeve means extending within and surrounded by said one or more elements, said releasable means initially interconnecting said upper sleeve means and intermediate sleeve means and said intermediate sleeve means and lower sleeve means.

3. A well tool adapted to be lowered in a well conduit disposed in a well bore, comprising body means, expander means on said body means, normally retracted slip means coacting with said expander means, normally retracted packing means on said body means, actuating means on said body means for effecting relative longitudinal movement between said expander means and slip means to expand said slip means into anchoring engagement with the well conduit, said actuating means including means for expanding said packing means against the well conduit, and releasable means for preventing said actuating means from expanding said packing means against the well conduit until said slip means have first been expanded against the well conduit; said packing means being above said slip means and including one or more elastomer packing elements, said actuating means including upper sleeve means engaging the upper end of said one or more elements, lower sleeve means engaging the lower end of said one or more elements, and intermediate sleeve means extending within and surrounded by said one or more elements, said releasable means comprising a shear device interconnecting said upper sleeve means and intermediate sleeve means and a shear device interconnecting said intermediate sleeve means and lower sleeve means.

4. A well tool as defined in claim 2; said intermediate sleeve means comprising an upper booster sleeve slidably sealed against said body means and engageable with said upper sleeve means, said intermediate sleeve means further comprising a lower booster sleeve slidably sealed against said body means and engageable with said lower sleeve means.

5. A well tool as defined in claim 1; said packing means being above said slip means and including one or more elastomer packing elements, said actuating means including upper sleeve means engaging the upper end of said one or more elements, lower sleeve means engaging the lower end of said one or more elements, and intermediate sleeve means extending within and surrounded by said one or more elements, said releasable means comprising a shear device interconnecting said upper sleeve means and intermediate sleeve means and a shear device interconnecting said intermediate sleeve means and lower sleeve means, said intermediate sleeve means comprising an upper booster sleeve slidably sealed against said body means and engageable with said upper sleeve means, said intermediate sleeve means further comprising a lower booster sleeve slidably sealed against said body means and engageable with said lower sleeve means.

6. A well tool as defined in claim 1; means preventing upward movement of said actuating means relative to said body means while permitting downward movement of said actuating means relative to said body means.

7. A well tool as defined in claim 1; means including one-way clutching means preventing upward movement of said actuating means relative to said body means while permitting downward movement of said actuating means relative to said body means.

8. A well tool as defined in claim 7; said one-way clutching means comprising coengageable ratchet teeth on said body means and said actuating means.

9. A well tool as defined in claim 2; means preventing upward movement of said upper sleeve member relative to said body means while permitting downward movement of said upper sleeve means relative to said body means, means preventing upward movement of said lower sleeve means relative to said body means while permitting downward movement of said lower sleeve means relative to said body means.

10. A well tool as defined in claim 2; means including first one-way clutching means preventing upward movement of said upper sleeve means relative to said body means while permitting downward movement of said upper sleeve means relative to said body means, means including second one-way clutching means preventing upward movement of said lower sleeve means relative to said body means while permitting downward movement of said lower sleeve means relative to said body means.

11. A well tool as defined in claim 10; said first one-way clutching means comprising coengageable ratchet teeth on said body means and upper sleeve means, said second one-way clutching means comprising coengageable ratchet teeth on said body means and lower sleeve means.

12. A well tool adapted to be lowered in a well conduit disposed in a well bore, comprising body means, expander means on said body means, normally retracted slip means coacting with said expander means, normally retracted packing means on said body means, actuating means on said body means for effecting relative longitudinal movement between said expander means and slip means to expand said slip means into anchoring engagement with the well conduit, said actuating means including means for expanding said packing means against the well conduit, and releasable means for preventing said actuating means from expanding said packing means against the well conduit until said slip means have first been expanded against the well conduit; said packing means being above said slip means and including one or more elastomer packing elements; said actuating means including upper sleeve means and engaging the upper end of said one or more elements, lower sleeve means engaging the lower end of said one or more elements, means including first one-way clutching means preventing upward movement of said upper sleeve means relative to said body means while permitting downward movement of said upper sleeve means relative to said body means, and means including second one-way clutching means preventing downward movement of said lower sleeve means relative to said body means while permitting upward movement of said lower sleeve means relative to said body means.

13. A well tool as defined in claim 12; said first one-way clutching means comprising coengageable ratchet teeth between said body means and upper sleeve means, said second one-way clutching means comprising coengageable ratchet teeth between said lower sleeve means and body means.

14. A well tool as defined in claim 4; means including first one-way clutching means preventing upward movement of said upper sleeve means relative to said body means while permitting downward movement of said upper sleeve means relative to said body means, means including second one-way clutching means preventing upward movement of said lower sleeve means relative to said body means while permitting downward movement of said lower sleeve means relative to said body means.

15. A well tool as defined in claim 14; said first one-way clutching means comprising coengageable ratchet teeth on said body means and upper sleeve means, said second one-way clutching means comprising coengageable ratchet teeth on said body means and lower sleeve means.

16. A well tool as defined in claim 4; means including first one-way clutching means preventing upward movement of said upper sleeve means relative to said body means while permitting downward movement of said upper sleeve means relative to said body means, and means including second one-way clutching means preventing downward movement of said lower sleeve means relative to said body means while permitting upward movement of said lower sleeve means relative to said body means.

17. A well tool adapted to be lowered in a well conduit disposed in a well bore, comprising body means, expander means on said body means, normally retracted slip means coacting with said expander means, normally retracted packing means on said body means, actuating means on said body means for effecting relative longitudinal movement between said expander means and slip means to expand said slip means into anchoring engagement with the well conduit, said actuating means including means for expanding said packing means against the well conduit, and releasable means for preventing said actuating means from expanding said packing means against the well conduit until said slip means have first been expanded against the well conduit; and fluid operable means for shifting said actuating means downwardly of said body means to expand said slip means and packing means.

18. A well tool as defined in claim 17; and means releasably securing said fluid operable means to said body means.

19. A well tool as defined in claim 1; and means for releasing said slip means and packing means from the well conduit.

20. A well tool as defined in claim 1; and means responsive to manipulation of said body means for releasing said slip means and packing means from the well conduit.

21. A well tool adapted to be lowered in a well conduit disposed in a well bore, comprising body means, expander means on said body means, normally retracted slip means coacting with said expander means, normally retracted packing means on said body means, actuating means on said body means for effecting relative longitudinal movement between said expander means and slip means to expand said slip means into anchoring engagement with the well conduit, said actuating means including means for expanding said packing means against the well conduit, and releasable means for preventing said actuating means from expanding said packing means against the well conduit until said slip means have first been expanded against the well conduit; means including a threaded connection between said expander means and body means for securing said expander means to said body means which is releasable in response to rotation of said body means to release said slip means and packing means from the well conduit.

22. A well tool as defined in claim 1; means for securing said expander means to said body means, and means for releasing said securing means to release said slip means and packing means from the well conduit.

23. A well tool adapted to be lowered in a well conduit disposed in a well bore, comprising body means, expander means on said body means, normally retracted slip means coacting with said expander means, normally retracted packing means on said body means above said expander means and slip means, actuating means on said body means for effecting relative longitudinal movement between said expander means and slip means to expand said slip means into anchoring engagement with the well conduit, said packing means including one or more elastomer packing elements, said actuating means including an upper sleeve means engaging the upper end of said one or more elements, lower sleeve means engaging the lower end of said one or more elements, intermediate sleeve means within and surrounded by said one or more elements, said packing means being expanded against the well conduit in response to relative longitudinal movement of said upper sleeve means toward said lower sleeve means, said intermediate sleeve means comprising an upper booster sleeve slidably sealed against said body means and engageable with said upper sleeve means, said intermediate sleeve means further comprising a lower booster sleeve slidably sealed against said body means and engageable with said lower sleeve means.

24. A well tool as defined in claim 23; first means preventing upward movement of said upper sleeve means relative to said body means while permitting downwardly movement of said upper sleeve means relative to said body means, second means preventing downward movement of said lower sleeve means relative to said body means while permitting upward movement of said lower sleeve means relative to said body means.

25. A well tool as defined in claim 24; said first means comprising coengageable ratchet teeth between said body means and upper sleeve means, said second means comprising coengageable ratchet teeth located between said lower sleeve means and body means.

26. A well tool adapted to be lowered in a well conduit disposed in a well bore, comprising body means, normally retracted packing means on said body means including one or more elastomer packing elements, upper sleeve means engaging the upper end of said one or more elements, lower sleeve means engaging the lower end of said one or more elements, intermediate sleeve means within and surrounded by said one or more elements, means for shifting said upper sleeve means relatively toward said lower sleeve means to expand said packing means against the well conduit, said intermediate sleeve means comprising an upper booster sleeve slidably sealed against the body means and engageable with said upper sleeve means, said intermediate sleeve means further comprising a lower booster sleeve slidably sealed against said body means and engageable with said lower sleeve means.

27. A well tool as defined in claim 26; first means preventing upward movement of said upper sleeve means relative to said body means while permitting downwardly movement of said upper sleeve means relative to said body means, second means preventing downward movement of said lower sleeve means relative to said body means while permitting upward movement of said lower sleeve means relative to said body means.

28. A well tool as defined in claim 27; said first means comprising coengageable ratchet between said body means and upper sleeve means, said second means comprising coengageable ratchet teeth located between said lower sleeve means and body means.

29. A well tool adapted to be lowered in a well conduit disposed in a well bore, comprising body means, expander means on said body means, normally retracted slip means coacting with said expander means, normally retracted packing means on said body means, actuating means on said body means for effecting relative longitudinal movement between said expander means and slip means to expand said slip means into anchoring engagement with the well conduit, said actuating means including means for expanding said packing means against the well conduit, and releasable means for preventing said actuating means from expanding said packing means against the well conduit until said slip means have first been expanded against the well conduit, said expander means comprising an upper expander means and a lower expander means between which said slip means are positioned, said actuating means being connected to said upper expander means to shift said upper expander means toward said lower expander means to expand said slip means into anchoring engagement with the well conduit, means releasably connecting said lower expander means to said body means, release of said connecting means enabling said lower expander means to move downwardly of said body means to effect release of said slip means from the well conduit.

30. A well tool as defined in claim 29; said connecting means comprising a threaded connection between said lower expander means and body means.

31. A well tool as defined in claim 29; said releasable connecting means comprising laterally movable elements coupled to said lower expander means and supported by said body means, retaining means engaging said laterally movable elements to retain said movable elements coupled to said lower expander means, said retaining means being shiftable to a position released from said laterally movable elements to permit said movable elements to retract laterally from said lower expander means, enabling said lower expander means to move downwardly of said body means and effect release of said slip means from the well conduit.

32. A well tool as defined in claim 31; and means engageable with said retaining means to shift said retaining means longitudinally to released position with respect to said movable elements.

33. A well tool as defined in claim 29; and means acting between said upper expander means and slip means to prevent downward movement of said upper expander means relative to said slip means until at least part of said slip means has been expanded against the well conduit.

34. A well tool as defined in claim 29; and shearable means acting between said upper expander means and slip means to prevent downward movement of said upper expander means relative to said slip means until at least part of said slip means has been expanded against the well conduit.

35. A well tool as defined in claim 2; said expander means comprising an upper expander means and a lower expander means between which said slip means are positioned, said actuating means being connected to said upper expander means to shift said upper expander means toward said lower expander means to expand such slip means into anchoring engagement with the well conduit, means releasably connecting said lower expander means to said body means, release of said connecting means enabling said lower expander means to move dowwardly of said body means to effect release of said slip means from the well conduit.

36. A well tool as defined in claim 35; said intermediately sleeve means comprising an upper booster sleeve slidably sealed against said body means and engageable with said upper sleeve means; said intermediate sleeve means further comprising a lower booster sleeve slidably sealed against said body means and engageable with said lower sleeve means.

37. A well tool as defined in claim 35; said connecting means comprising a threaded connection between said lower expander and body means.

38. A well tool as defined in claim 37; said connecting means comprising laterally movable elements coupled to said lower expander means and supported by said body means, retaining means engaging said laterally movable elements to retain said movable elements coupled to said lower expander means, said retaining means being shiftable to a position released from said laterally movable elements to permit said movable elements to retract laterally from said lower expander means, enabling said lower expander means to move downwardly of said body means and effect release of said slip means from the well conduit.

39. A well tool as defined in claim 38; said laterally movable elements being threadedly connected to said lower expander means.

40. A well tool adapted to be lowered in a well conduit disposed in a well bore, comprising body means, expander means on said body means, normally retracted slip means coacting with said expander means, normally retracted packing means on said body means, actuating means on said body means for effecting relative longitudinal movement between said expander means and slip means to expand slip means into anchoring engagement with the well conduit, said actuating means including means for expanding said packing means against the well conduit, and releasable means for preventing said actuating means from expanding said packing means against the well conduit until said slip means have first been expanded against the well conduit; first fluid operable means for shifting said actuating means downwardly of said body means to expand said slip means and packing means, said first fluid operable means being adapted to act upwardly on said actuating means in response to fluid pressure externally of said body means and above said packing means, and second fluid operable means adapted to act downwardly on said actuating means in response to said external fluid pressure to offset said external fluid pressure acting upwardly on said first fluid operable means.

41. A well tool as defined in claim 40; said first fluid operable means comprising a lower piston engageable with said actuating means, said second fluid operable means comprising an upper piston engageable with said actuating means.

42. A well tool as defined in claim 2; first fluid operable means for shifting said upper sleeve means downwardly of said body means to expand said slip means and packing means, said first fluid operable means being adapted to act upwardly on said upper sleeve means in response to fluid pressure externally of said body means and above said packing means, and second fluid operable means adapted to act downwardly on said upper sleeve means in response to said external fluid pressure to offset said external fluid pressure acting upwardly on said first fluid operable means.

43. A well tool as defined in claim 42, said first fluid operable means comprising a lower piston engageable with said upper sleeve means, said second fluid operable means comprising an upper piston engageable with said upper sleeve means.

* * * * *